US007040454B2

(12) United States Patent
Kawamoto et al.

(10) Patent No.: US 7,040,454 B2
(45) Date of Patent: May 9, 2006

(54) DRY-SUMP LUBRICATION TYPE FOUR-STROKE CYCLE ENGINE

(75) Inventors: Yuichi Kawamoto, Akashi (JP); Kiyohito Takano, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 494 days.

(21) Appl. No.: 10/455,622

(22) Filed: Jun. 6, 2003

(65) Prior Publication Data

US 2004/0245050 A1 Dec. 9, 2004

(51) Int. Cl.
*F16N 31/00* (2006.01)

(52) U.S. Cl. ..... 184/106; 123/196 R

(58) Field of Classification Search ..... 184/6, 184/106; 123/196 R
See application file for complete search history.

(56) References Cited

U.S. PATENT DOCUMENTS 4,674,457 A * 6/1987 Berger et al. ..... 123/196 R
4,915,070 A * 4/1990 Okui ..... 123/196 R
6,205,987 B1 * 3/2001 Shigedomi et al. ..... 123/583
6,823,829 B1 * 11/2004 Kawamoto et al. ..... 123/196 R
2002/0053489 A1 * 5/2002 Schnitzer ..... 184/6.12
2003/0101959 A1 * 6/2003 Hare ..... 123/196 R

FOREIGN PATENT DOCUMENTS

| | | |
|---|---|---|
| JP | A 61-215411 | 9/1986 |
| JP | 01-169171 | 7/1989 |
| JP | 04-292514 | 10/1992 |
| JP | 06-248927 | 9/1994 |
| JP | A 6-288466 | 10/1994 |
| JP | A 8-135419 | 5/1996 |
| JP | 11-148309 | 6/1999 |
| JP | 2002-040409 | 2/2002 |

* cited by examiner

*Primary Examiner*—David Fenstermacher
(74) *Attorney, Agent, or Firm*—Oliff & Berridge, PLC

(57) ABSTRACT

The interior of a crankcase is divided into a front crank chamber and a rear transmission chamber by a partition wall of a given height. A lower part of the transmission case is used as an oil reservoir chamber for reserving lubricating oil. Opposite ends of the crankcase are covered with covers to form a generator chamber and a clutch chamber. The crank chamber is connected to the generator chamber by a drain passage to drain oil collected in the crank chamber into the generator chamber. A scavenging pump placed in the clutch chamber sucks the oil collected in the generator chamber through an oil passage extending across the crankcase under the crank chamber and discharges the oil into an air space in the clutch chamber.

11 Claims, 17 Drawing Sheets

DRY-SUMP LUBRICATION TYPE FOUR-STROKE CYCLE ENGINE

BACKGROUND OF THE INVENTION

1. Field of the Invention

The present invention relates to a dry-sump lubrication type four-stroke cycle engine suitable for a vehicle, such as a straddle type all-terrain four-wheel vehicle or a motorcycle, and, more specifically to improvements in an oil holding and circulating system.

2. Description of the Related Art

A conventional dry-sump lubrication four-stroke cycle engine usually has an oil tank separated from a crankcase of the engine, an oil feed pump and an oil return pump (scavenging pump). The oil tank holds a predetermined quantity of an engine oil. The oil feed pump pumps up the oil from the oil tank and feeds the oil by pressure to parts needing lubrication of the engine, and the oil return pump pumps up the used oil collected in the bottom of the crankcase or an oil pan and returns the used oil into the oil tank.

This dry-sump lubrication system increases the weight, component parts and cost of the engine, and needs pipes for connecting the crankcase and the oil tank.

A dry-sump lubrication type four-stroke cycle engine previously proposed by the assignee of the present patent application in JP-A No. 288466/1994 or JP-A No. 135419/1996 is not provided with any external oil tank and has a transmission chamber formed in a rear part of a crankcase of the engine and capable of holding a predetermined quantity of the engine oil. In this previously proposed dry-sump lubrication type four-stroke cycle engine, a suction port of a scavenging pump opens into an interior of a crank chamber of the crankcase, the scavenging pump sucks up the oil collected in the crank chamber and returns the oil into the transmission chamber to maintain the interior of the crank chamber in a dry state.

An engine disclosed in JP-A No. 215411/1986 is provided with a crankcase having a crank chamber and a transmission chamber. A lower part of the transmission chamber is used as an oil chamber. The crank chamber and the transmission chamber are separated by a partition wall, and the engine oil is contained in the oil chamber in the lower part of the transmission chamber. Right and left cover chambers provided at both sides of the crankcase are connected by an oil passage. The oil is allowed to flow from the crank chamber into the cover chambers, and a scavenging pump sucks the oil from the cover chambers and discharges the oil into the oil chamber.

The engine disclosed in JP-A No. 288466/1994 or JP-A No. 135419/1996, which sucks the oil directly from the crank chamber by the scavenging pump has the following problems.

(1) The pressure in the crank chamber varies repeatedly according to the variation of the volume of the crank chamber due to the reciprocation of the piston. Since the scavenging pump sucks the oil directly from the crank chamber, the suction of the scavenging pump is affected by the pressure variation in the crank chamber, the suction rate of the scavenging pump varies and the pumping ability of the scavenging pump cannot be fully utilized.

(2) Crank arms of the rotating crankshaft contained in the crank chamber agitate and splash the oil collected in the bottom of the crank chamber. The oil exerts resistance against the revolution of the crank arms and produces agitation loss.

(3) The oil flows in the reverse direction into the crank chamber gradually while the engine is stopped for a long time.

The engine disclosed in JP-A No. 215411/1986 has the following problems.

(1) Since the right and left cover chambers always communicate with each other, and a fixed quantity of oil is held always in the covers, a large quantity of oil flows into the crank chamber when the engine is tilted beyond a certain angle and hence it is possible that the crank chamber cannot be maintained in a dry state.

(2) Since the scavenging pump sucks the oil from the cover chambers and discharges the oil into the oil chamber, air cannot be satisfactorily removed from the oil and the oil containing air is returned to the oil chamber, which causes aeration in an oil feed pump.

SUMMARY OF THE INVENTION

The present invention has been made in view of the foregoing problems and it is therefore an object of the present invention to provide a compact dry-sump lubrication type four-stroke cycle engine provided with a lightweight lubricating system comprising a small number of component parts, being capable of efficiently using an oil pump and having an increased oil reverse capacity and simple oil passages formed in the crankcase.

According to one aspect of the present invention, a dry-sump lubrication type four-stroke cycle engine comprises: a crankcase in which a crank chamber is formed in its front part and a transmission chamber is formed in its rear part, the crankcase having a pair of end walls positioned at one end and other end along a crank axis direction, respectively; a first cover and a second cover disposed on the end walls of the crankcase, respectively; and a first chamber and a second chamber formed in the first cover and the second cover, respectively, wherein a partition wall of a given height is provided between the crank chamber and the transmission chamber so as to form an oil reservoir chamber in a lower part of the transmission chamber separated from the crank chamber by the partition wall, wherein one of the end walls is provided with a drain passage through which oil drains from the crank chamber into the first chamber, wherein the second chamber has a second oil reservoir chamber which communicates with the oil reservoir chamber so that a level of oil contained in the second oil reservoir chamber is equal to a level of oil in the oil reservoir chamber, and wherein the engine further comprising a scavenging pump pumping up oil from the first chamber and discharges oil into the oil reservoir chamber or the second oil reservoir chamber.

Since the oil reservoir chamber is formed in the crankcase, the dry-sump lubrication type four-stroke cycle engine of the present invention needs parts necessary for defining the oil reservoir chamber less than those necessary for forming the external oil tank of the conventional dry-sump lubrication type four-stroke cycle engine, and has weight less than that of the conventional dry-sump lubrication type four-stroke cycle engine, does not need any space for the external oil tank and external pipings for the oil tank. Thus, the dry-sump lubrication type four-stroke cycle engine of the present invention is compact and can be manufactured at a low cost.

Since the dry-sump lubrication type four-stroke cycle engine of the present invention uses the second chamber as the second oil reservoir chamber, the quantity of the oil that can be reserved in the engine can be increased without enlarging the crankcase.

Since the scavenging pump sucks the oil from the first chamber instead of sucking the oil directly from the crank chamber, the pumping effect of the scavenging pump is not affected by the pressure variation in the crank chamber, the scavenging pump is able to suck and discharge the oil stably, and the scavenging pump is able to suck an increased quantity of the oil and to return the oil surely from the crank chamber into the oil reservoir chamber.

Since the oil flows from the crank chamber into the first chamber, and the scavenging pump sucks the oil contained in the first chamber, crank arms of a crank shaft in the crank chamber do not splash the oil in the crank chamber and hence the oil does not cause any agitation loss.

Preferably, the first and the second chamber may be connected by an oil passage. The scavenging pump may be disposed in the second chamber, and a suction port of the scavenging pump may be connected to one end of the oil passage to suck oil directly from the first chamber.

The scavenging pump can be disposed compactly by using a space in the second chamber and the scavenging pump needs simple piping. Since the first chamber communicating with the crank chamber by means of the drain passage is kept in a dry state by the scavenging pump, the oil can hardly reverse from the first chamber into the crank chamber even if the engine tilts during operation, and the reduction of power transmission efficiency due to power loss caused by the resistance of the oil contained in the crank chamber against the revolution of the crank arms can be prevented.

Preferably, the oil passage may be formed below the drain passage connecting the crank chamber to the first chamber so as to extend under the crank chamber across the crankcase.

Such an arrangement of the drain passage and the oil passage enhances the effect of preventing the reverse flow of the oil and prevents deteriorating the dry state of the crank chamber, and enables effectively using the lower space of the crank chamber as the oil passage.

Preferably, the oil passage is formed integrally with the crankcase.

Thus, piping associated with the scavenging pump can be formed by a small number of parts.

Preferably, the scavenging pump is placed in the second chamber so as to position a rotor thereof below a predetermined oil level in the second oil reservoir chamber.

Preferably, the scavenging pump placed in the second chamber is sealed so that oil is unable to flow in a reverse direction from the second chamber.

Thus, the reverse flow of the oil from the second chamber can be prevented even if the engine is stopped for a long time, the oil can be held at a fixed level in the second chamber, which enables accurate measurement of the oil level.

Preferably, the scavenging pump may have a discharge opening at a level above a level of oil in the second chamber to discharge oil into air.

Thus, gases contained in the oil sucked by the scavenging pump can be separated from the oil, and only the oil can be pumped into the second oil reservoir chamber in the second chamber.

Preferably, a flat filter may be placed in the oil passage.

Thus, any extra space for the filter is not necessary, and the flat filter can be easily placed in and removed from the oil passage.

Preferably, a generator of the engine is placed in the first chamber communicating with the crank chamber, and a clutch of the engine is placed in the second chamber communicating with the oil reservoir chamber.

A dead space under the clutch can be effectively used for accommodating the scavenging pump.

Preferably, the clutch may be placed in the second chamber so that the clutch is not immersed in oil.

Thus, the oil does not exert any resistance on the clutch when the clutch rotates, which prevents the reduction of power transmission efficiency.

Preferably, transmission gears of a transmission installed in the transmission chamber are disposed so that the transmission gears are not immersed in oil contained in the oil reservoir chamber, and an oil spraying unit is placed in the transmission chamber to spray oil on the transmission gears.

Thus, the lower part of the transmission chamber can be effectively used as the oil reservoir chamber, the transmission gears can be properly lubricated, the transmission gears do not agitate the oil, and hence the reduction of power transmission efficiency due to agitation loss can be prevented.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

[Straddle Type All-terrain Four-wheel Vehicle]

Figure 1:
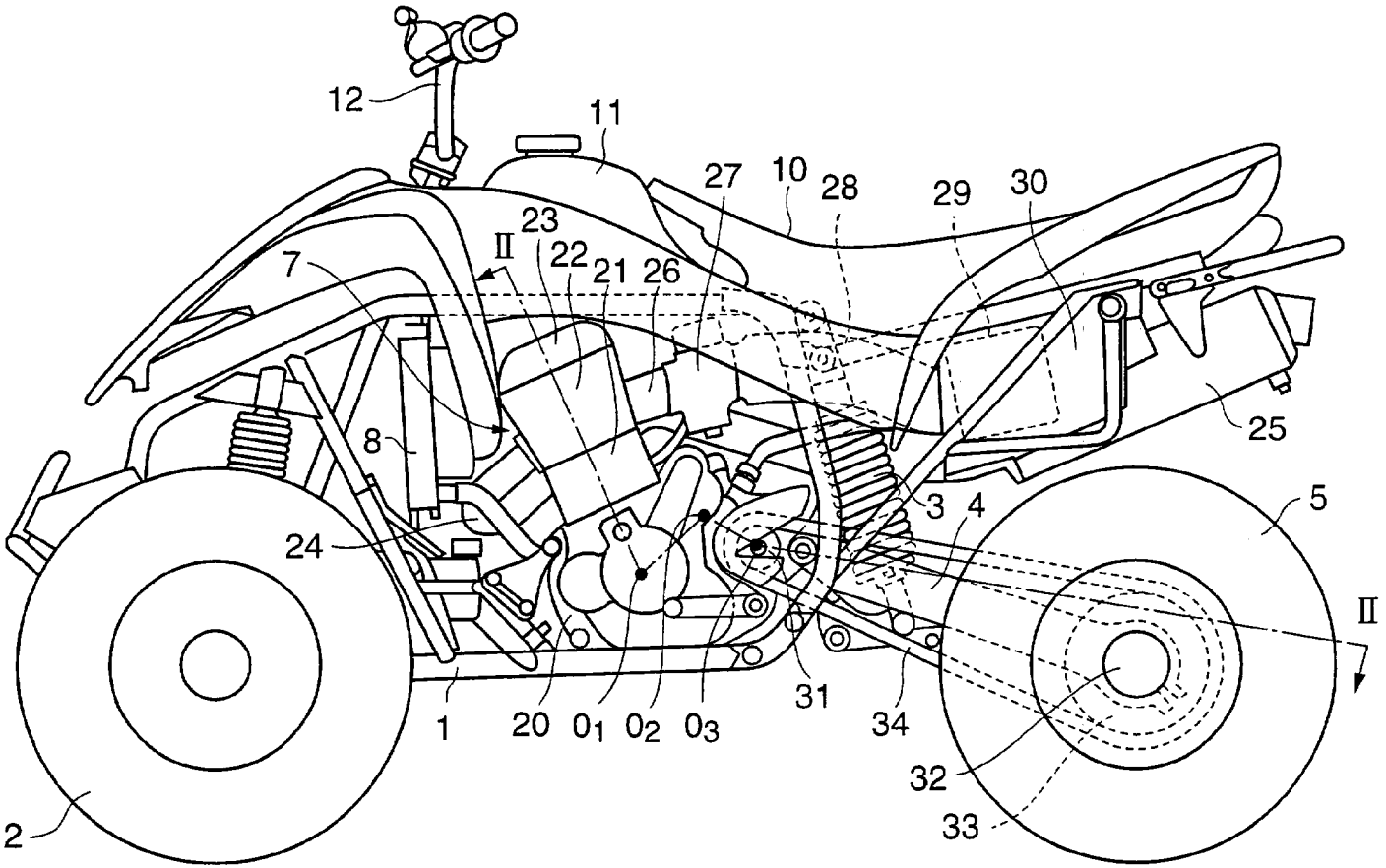
FIG. 1 is a side elevation of a straddle type all-terrain four-wheel vehicle provided with a dry-sump lubrication type four-stroke cycle engine in a preferred embodiment according to the present invention.

Referring to FIG. 1 showing a straddle type all-terrain four-wheel vehicle provided with a dry-sump lubrication type four-stroke cycle engine 7 (hereinafter referred to simply as "engine") in a preferred embodiment according to the present invention, right and left front wheels 2 are supported on a front part of a body frame 1, a right and left rear wheels 5 are supported on a swing arm 4 pivotally supported on a rear part of the main frame 1. The swing motion of the swing arm 4 is controlled by a shock absorber 3. The engine 7 and a radiator 8 are mounted on the main frame 1. A straddle-type seat 10, a fuel tank 11 and a handlebar 12 are arranged in an upper part of the main frame 1.

The engine 7 is built by stacking and fastening together a cylinder 21, a cylinder head 22 and a cylinder head cover 23 in that order on a crankcase 20. An exhaust pipe 24 is connected to an exhaust port formed in a front part of the cylinder head 22. The exhaust pipe 24 is bent to the right and is extended rearward. A muffler 25 is connected to the rear end of the exhaust pipe 24. An intake pipe 26 is connected to an intake port formed in a rear part of the cylinder head 21. A carburetor 27, an intake duct 28 and an air cleaner 30 provided with an air cleaner element 29 are connected to the intake pipe 26.

The vehicle is provided with a chain-drive mechanism including a drive sprocket 31 mounted on the output shaft of the engine 7, a driven sprocket 33 mounted on a rear axle 32, and a drive chain 34 extended between the drive sprocket 31 and the driven sprocket 33. The rear wheels 5 are driven through the chain-drive mechanism by the engine 7. In FIG. 1, indicated at $O_1$ is the axis of a crankshaft, and at $O_2$ and $O_3$ are the axes of a transmission input shaft and a transmission output shaft included in a transmission, respectively.

[Engine]

Figure 2:
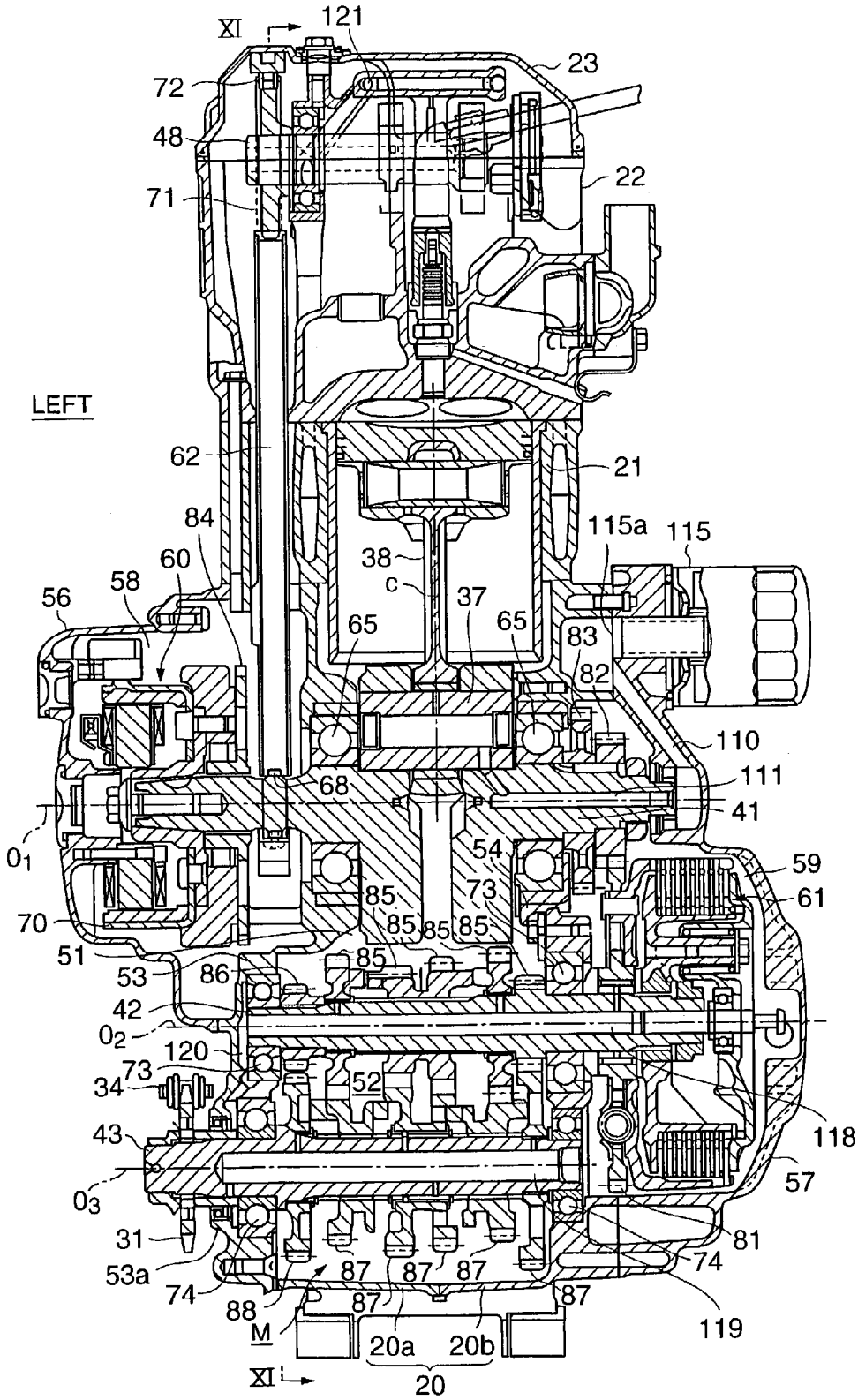
FIG. 2 is an enlarged, developed sectional view taken on the line II—II in FIG. 1.

FIG. 2 is an enlarged, developed sectional view taken on the line II—II passing the center axis C of a cylinder, the axis $O_1$ of the crankshaft, the axis $O_2$ of the transmission input shaft and the axis $O_3$ of the transmission output shaft in FIG. 1. As shown in FIG. 2, the crankcase 20 is formed by joining together a right half-crankcase **20*b* and a left half-crankcase 20*a* in a plane including the axis C of the cylinder and perpendicular to the axis $O_1$ of the crankshaft 41. The crankcase 20 has a crank chamber 51 in its front part and a transmission chamber in its rear part. The crankshaft 41 is placed in the crank chamber 51, and a transmission M is placed in the transmission chamber 52**.

A right crankcase cover 57 and a left crankcase cover 56 are fastened to the right end wall 54 and the left end wall 53, respectively, of the crankcase 20. A generator 60 is placed in a left end chamber 58 covered with the left crankcase cover 56. A multiple-disk clutch 61 is placed in the right end chamber 59 covered with the right crankcase cover 57.

In the following description, the left crankcase cover 56 and the left end chamber 58 will be referred to as a generator cover 56 and a generator chamber 58, respectively, and the right crankcase cover 57 and the right end chamber 59 will be referred to as a clutch cover 57 and a clutch chamber 59, respectively.

[Power Transmission System]

The crankshaft 41 is supported for rotation in bearings 65 on the right end wall 54 and the left end wall 53 of the crankcase 20. The crankshaft 41 is formed by connecting right and left shaft members by a crank pin 37. The crankshaft 41 has a left end part projecting into the generator chamber 58. A crankshaft sprocket 68, a starter gear 84 and a rotor 70 included in the generator 60 are mounted on the left end part of the crankshaft 41. The rotor 70 of the generator 60 serves also as a flywheel. A camshaft sprocket 72 is mounted on a camshaft 48 in a cylinder head cover 23. A timing chain 71 is extended through a timing chain tunnel 62 formed in a cylinder 21 and a cylinder head 22 between the crankshaft sprocket 68 and the camshaft sprocket 72.

The crankshaft 41 has a right end part projecting into the clutch chamber 59. A crankshaft gear 82 and a balancer drive gear 83 are fixedly mounted on the right end part of the crankshaft 41. The crankshaft gear 82 is engaged with a clutch gear 81 included in the multiple-disk clutch 61.

The transmission M has five forward speeds and reverse. A transmission input shaft 42 is supported in bearings 73 on the end walls 53 and 54 of the crankcase 20. Input forward-speed gears 85, namely, input 1st-speed, input 5th-speed, input 3rd-speed, input 2nd-speed and input 4th-speed gears 85, are arranged in that order from the right toward the left on the transmission input shaft 42. An input reverse gear 86 is mounted on a left end part of the transmission input shaft 42. The transmission input shaft 42 has a right end part projecting into the clutch chamber 59, and a hub included in the multiple-disk clutch 61 is mounted on the right end part of the transmission input shaft 42.

Figure 3:
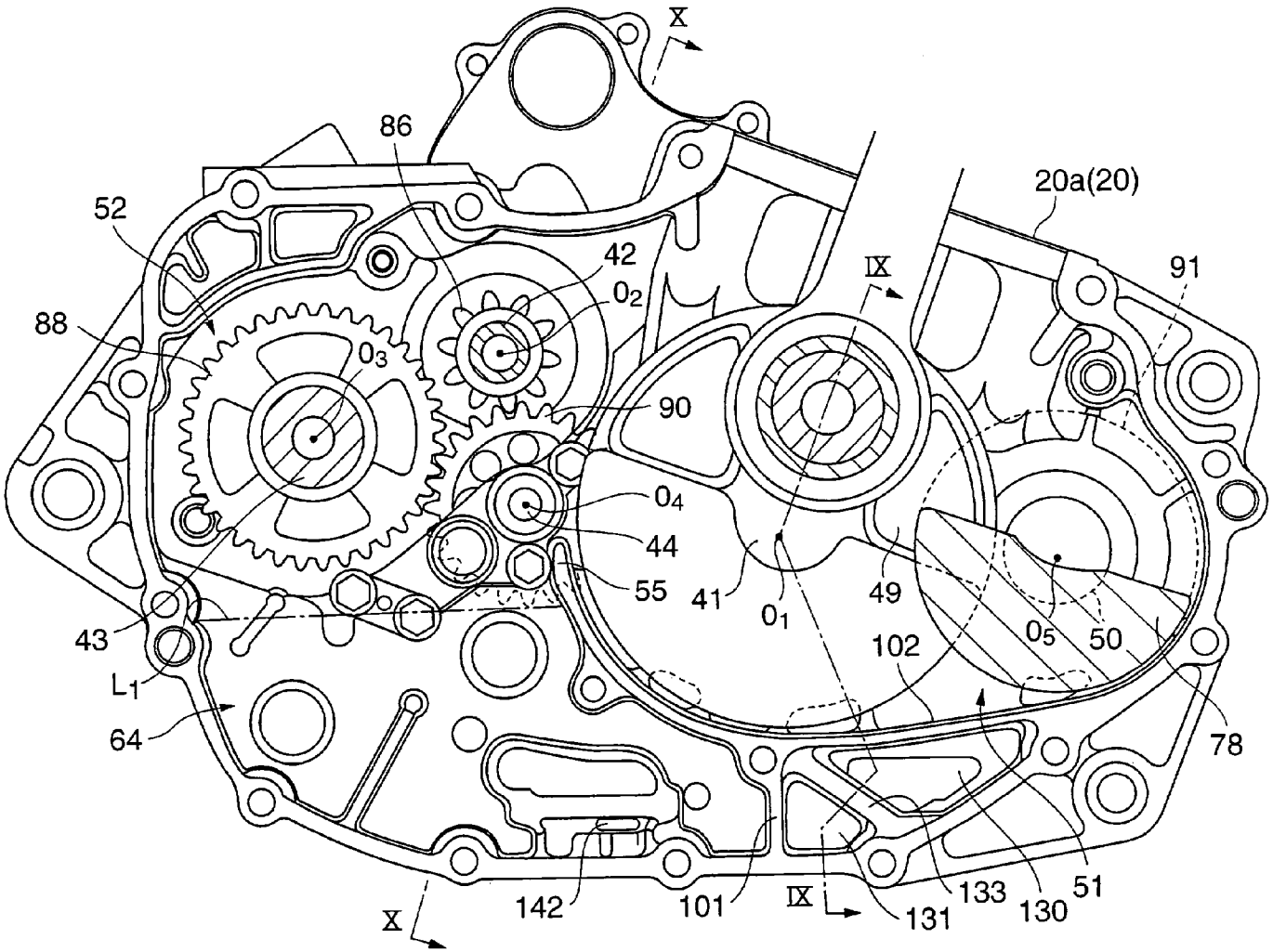
FIG. 3 is a side elevation of members in a left half-crankcase as viewed from the right side of the dry-sump lubrication type four-stroke cycle engine, in which a right half-crankcase is removed.

A transmission output shaft 43 is supported in bearings 74 on the end walls 53 and 54. The transmission output shaft 43 has a left end part projecting from the transmission chamber 52, and a drive sprocket 31 for driving the rear wheels is fixedly mounted on the left end part of the transmission output shaft 43. Output forward-speed gears 87, namely, output 1st-speed, output 5th-speed, output 3rd-speed, output 2nd-speed and output 4th-speed gears 87, are arranged in that order from the right toward the left on the transmission output shaft 43. An output reverse gear 88 is mounted on a left end part of the transmission output shaft 43. The output forward-speed gears 87 are engaged with the input forward-speed gears 85, respectively, and the output reverse gear 88 is engaged with a reverse idle gear 90 mounted on a reverse idle shaft 44 and engaged with the input reverse gear 86 as shown in FIG. 3.

Figure 8:
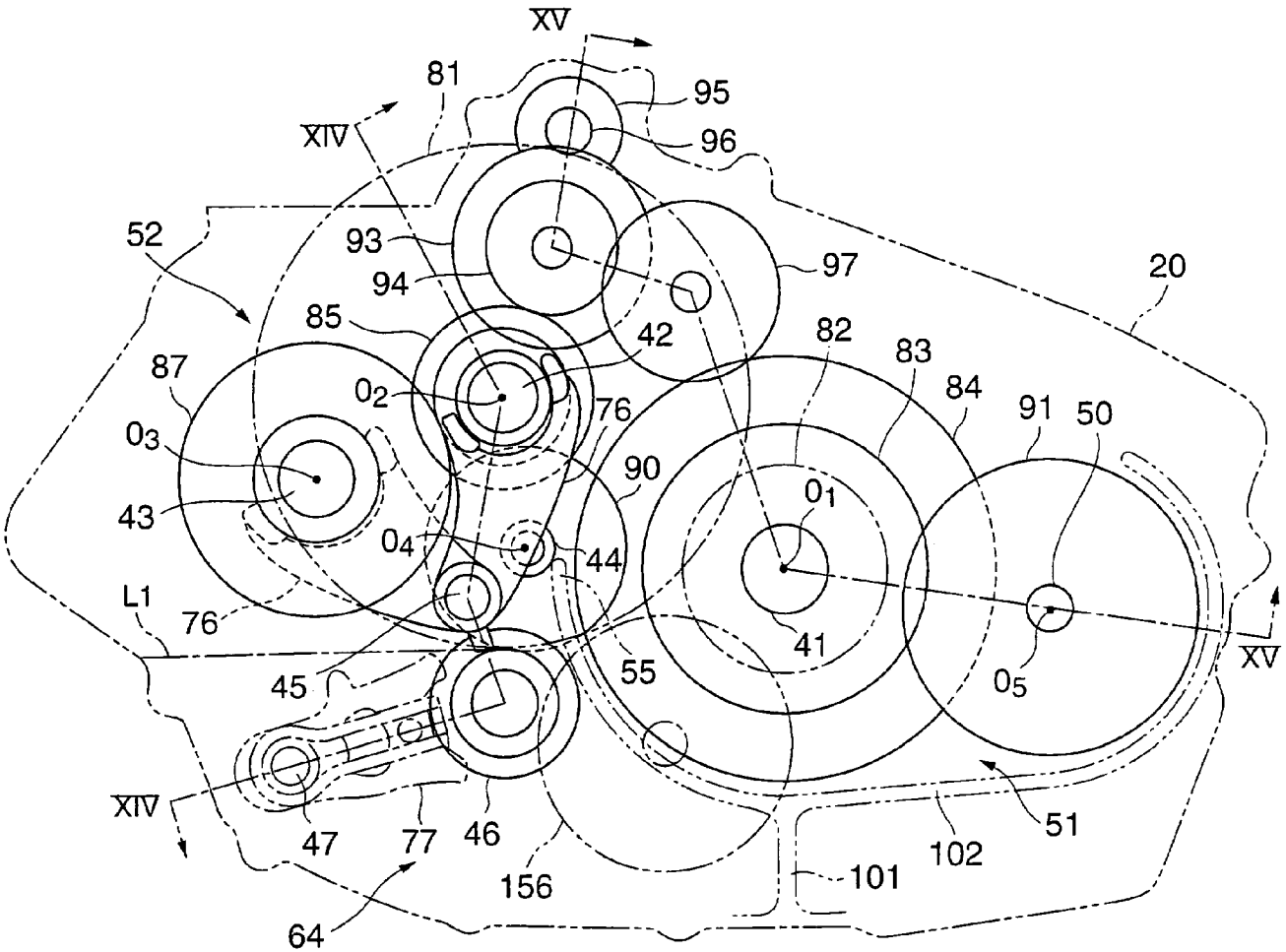
FIG. 8 is a side elevation of assistance in explaining the arrangement of shafts and gears of the dry-sump lubrication type four-stroke cycle engine.

Referring to FIG. 8 showing shafts and gears arranged in the engine, a shift rod 45, a speed-change drum 46 and a speed-change shaft 47 are disposed in a lower part of the transmission chamber 52. A plurality of shift forks 76 (three shift forks in this embodiment) are mounted on the shift rod 45. The shift forks 76 extend toward the transmission input shaft 42 and the transmission output shaft 43 and are engaged in grooves formed in shift sleeves, respectively. A swing arm 77 is connected to the speed-change shaft 47 to turn the speed-change drum 46 at predetermined angular steps.

A balancer shaft 50 is disposed in front of the crankshaft 41. A balancer gear 91 mounted on the balancer shaft 50 is engaged with the balancer drive gear 83 mounted on the crankshaft 41. A large starting intermediate gear 93 and a small starting intermediate gear 94 are mounted on a shaft disposed above the transmission input shaft 42. A starter motor 95 is disposed above the starting intermediate gears 93 and 94. The large starting intermediate gear 93 is engaged with a pinion 96 mounted on the output shaft of the starter motor 95, and the small starting intermediate gear 94 is engaged with a starting idle gear 97 disposed in front of the small starting intermediate gear 94 and engaged with a starting gear 84 mounted on the crankshaft 41.

Figure 15:
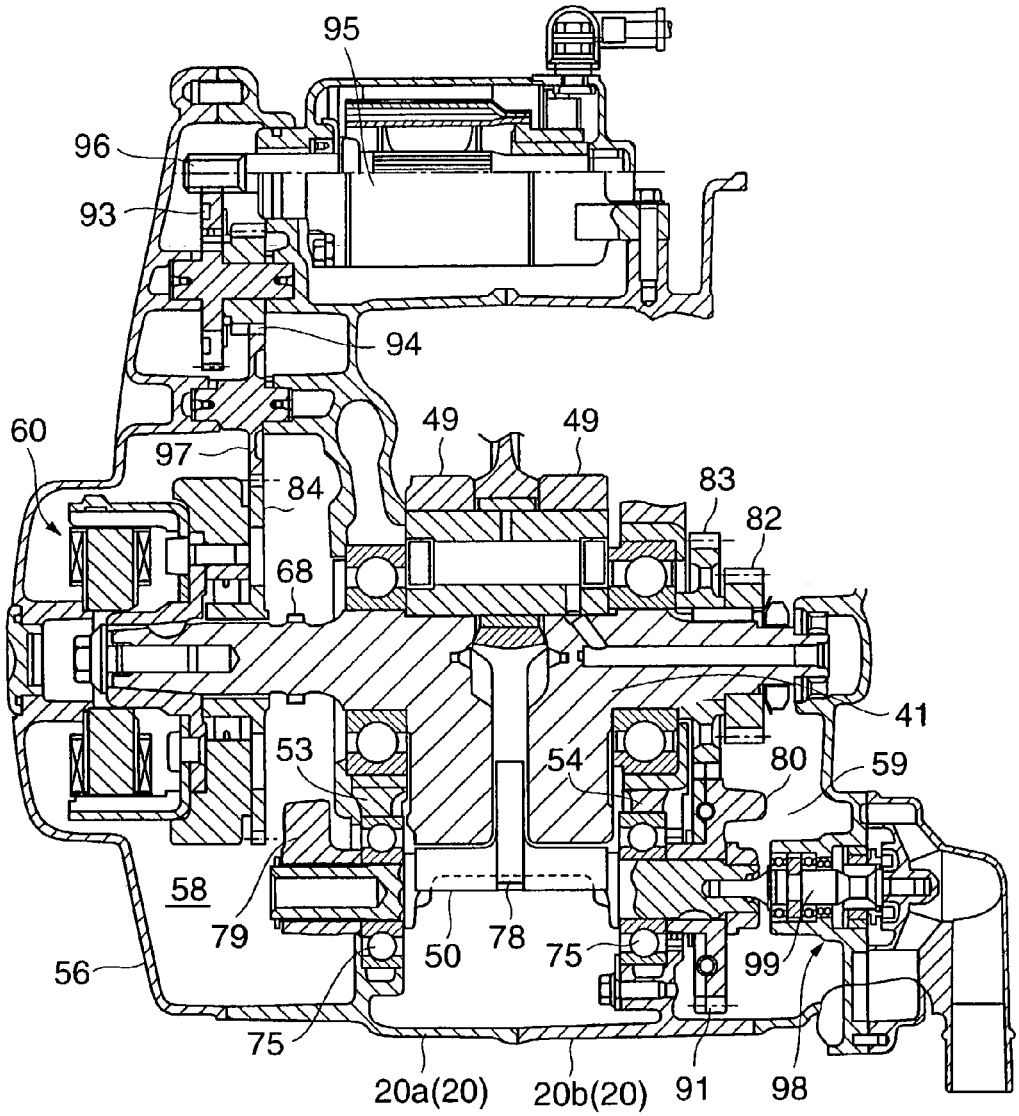
FIG. 15 is a sectional view taken on the line XV—XV in FIG. 8.

Referring to FIG. 15 showing the balancer shaft 50 and a starting mechanism, the balancer shaft 50 is supported for rotation in bearings 75 on the end walls 53 and 54 of the crankcase 20, and is provided with a middle weight 78, a left weight 79 and a right weight 80 on a middle part, a left end part and a right end part thereof, respectively. The middle weight 78 is disposed between crank arms (weights) 49 of the crankshaft 41, the left weight 79 is disposed in the generator chamber 58 substantially opposite to the crankshaft sprocket 68, and the right weight 80 is formed integrally with the balancer gear (scissors gear) 91 in the clutch chamber 59. A pump shaft 99 included in a water pump 98 is connected to the right end of the balancer shaft 50 by a coupling.

The large starting intermediate gear 93, the small starting intermediate gear 94 and the starting idle gear 97 of the starting mechanism are disposed in an upper part of the generator chamber 58, and the starter motor is attached to the upper wall of the crankcase 20.

[Lubrication System]

Referring to FIG. 2 showing an enlarged, developed sectional view taken on the line II—II in FIG. 1, the crankshaft 41 is internally provided with an oil passage 111 connected to an oil supply passage 110 formed in the clutch cover 57. The oil passage 111 extends through the outer surface of the crankpin 37 and a bore formed in the crankpin 37 to a part of the crankpin 37 in engagement with the large end of a connecting rod 38. The oil supply passage 110 formed in the clutch cover 57 is connected to an outlet part 115*a* of a secondary filter 115 attached to the clutch cover 57.

The transmission input shaft 42 and the transmission output shaft 43 are provided with oil passages 118 and 119, respectively. The oil passages 118 and 119 are connected to an oil chamber 120 formed in the left end wall 53 of the crankcase 20, and are opened in parts, on which the gears 85, 86, 87 and 88 are mounted, of the input shaft 42 and the output shaft 43. The cylinder head cover 23 is provided with an oil passage 121 for carrying oil to lubricate the sliding parts of the camshaft 48.

Figure 14:
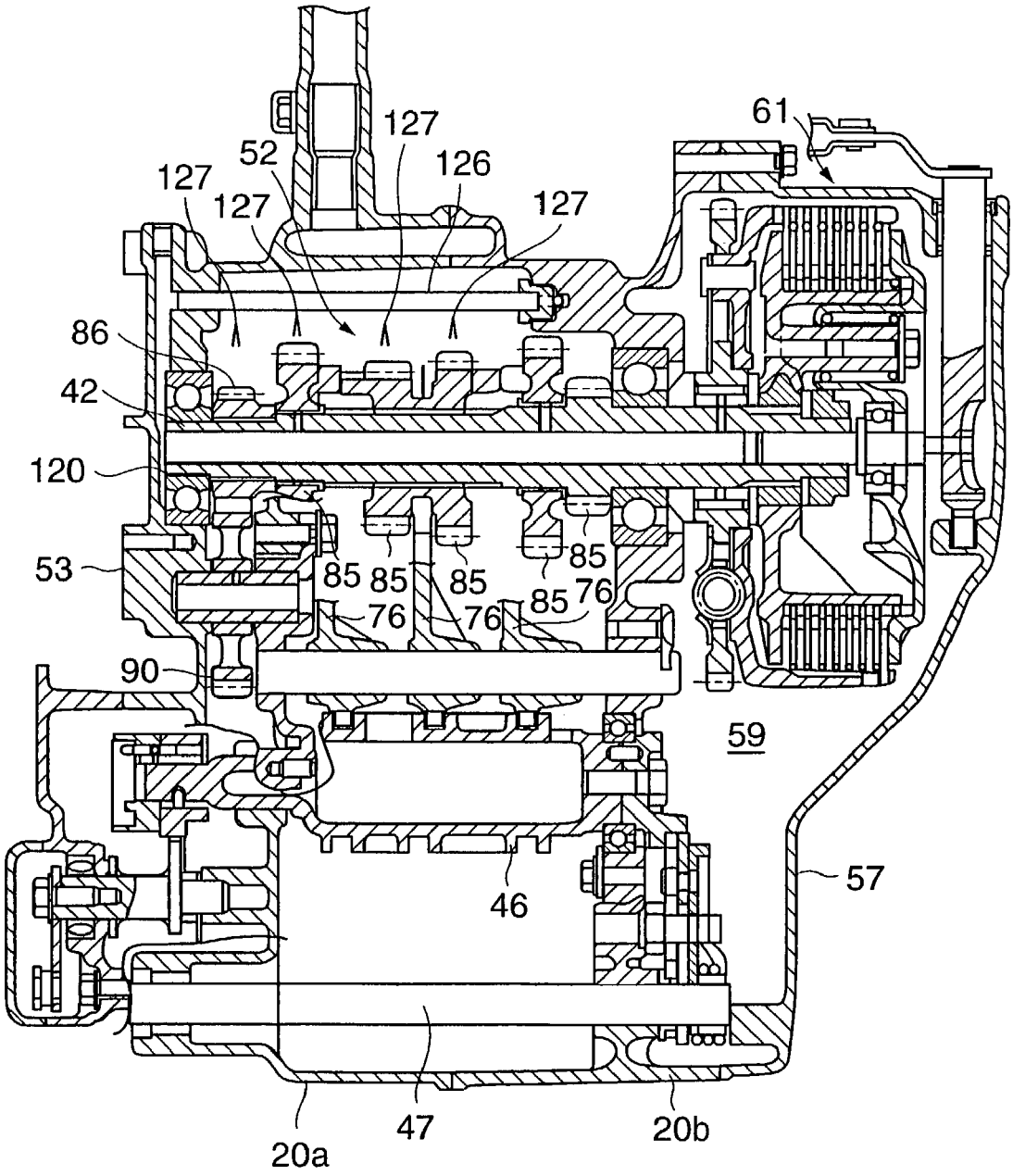
FIG. 14 is a sectional view taken on the line XIV—XIV in FIG. 8.

Referring to FIG. 14 showing a sectional view taken on the line XIV—XIV in FIG. 8, an oil spray pipe 126 is extended in parallel to the transmission input shaft 42 above the input forward-speed gears 85. The oil spray pipe 126 is connected to the oil chamber 120 formed in the left end wall 53 of the crankcase 20. The oil spray pipe 126 is provided with a plurality of spouting holes 127 in an axial arrangement. Oil is spouted through the spouting holes 127 onto the transmission gears.

[Oil Holding Structure in Crankcase]

FIG. 3 shows the inner surface of the left half-crankcase 20*a*. The crankcase 20 is provided with a partition wall 55 of a predetermined height between the crank chamber 51 and the transmission chamber 52. The partition wall 55 separates a lower part of the transmission chamber 52 from the crank chamber 51 to form an oil reservoir chamber 64. The upper edge of the partition wall 55 is on the substantially the same level as the axis $O_1$ of the crankshaft 41, and extends downward toward the front along the contour of the crank arms 49. The partition wall 55 is joined to a partition wall 101 extending downward substantially directly under the axis $O_1$ of the crankshaft 41. Thus, the oil reservoir chamber 64 extends to a position under the crank chamber 51. The lower part of the crank chamber 51 is demarcated by a bottom wall 102 extending toward the front from the front end of the partition wall 55, namely, the joint of the partition walls 55 and 101. The bottom wall 102 extends to a position below the balancer shaft 50 and extends further along the outer surface of the middle weight 78 of the balancer shaft 50 to the upper front end of the crank chamber 51.

The respective axes $O_2$, $O_3$ and $O_4$ of the transmission input shaft 42, the transmission output shaft and the reverse idle shaft 44 are on levels above that of the axis $O_1$ of the crankshaft 41 such that the lower ends of the transmission gears 85, 87 and 90 mounted on the shafts 42, 43 and 44 are substantially above an oil level $L_1$ of the oil contained in the oil reservoir chamber 64 and the transmission gears 85, 87 and 90 are scarcely immersed in the oil contained in the oil reservoir chamber 64. The oil level $L_1$ is the predetermined oil level of the maximum quantity of oil stored in the oil reservoir chamber 64. Thus, the oil does not exert resistance against the rotation of the transmission gears 85, 87 and 90 and hence the reduction of power transmission efficiency due to the resistance of the agitated oil can be prevented.

Figure 10:
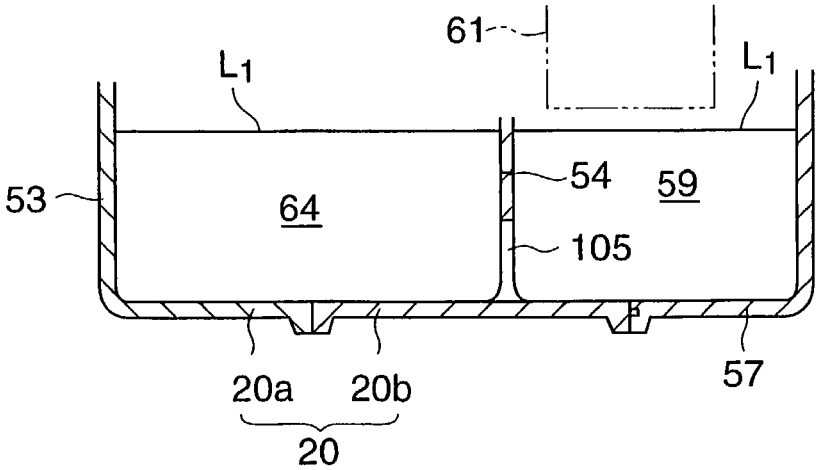
FIG. 10 is a schematic sectional view taken on the line X—X in FIG. 3.

Referring to FIG. 10 showing a sectional view taken on the line X—X in FIG. 3, the right end wall 54 of the crankcase 20 serving also as a wall defining the right end of the oil reservoir chamber 64 is provided with a connecting hole 105 at a level below the oil level $L_1$. The oil reservoir chamber 64 communicates with the clutch chamber 59 by means of the connecting hole 105. Thus, the level of oil contained in the clutch chamber 59 is equal to the oil level $L_1$ in the oil reservoir chamber 64. Thus, the clutch chamber 59 can be used as an expanded part of the oil reservoir chamber 64, i.e., a second oil reservoir chamber. The clutch 61 placed in the clutch chamber 59 at a level such that the lower end of the clutch 61 is not immersed in oil. Thus, the oil does not exert resistance against the rotation of the clutch 61, which prevents the reduction of power transmission efficiency.

Figure 6:
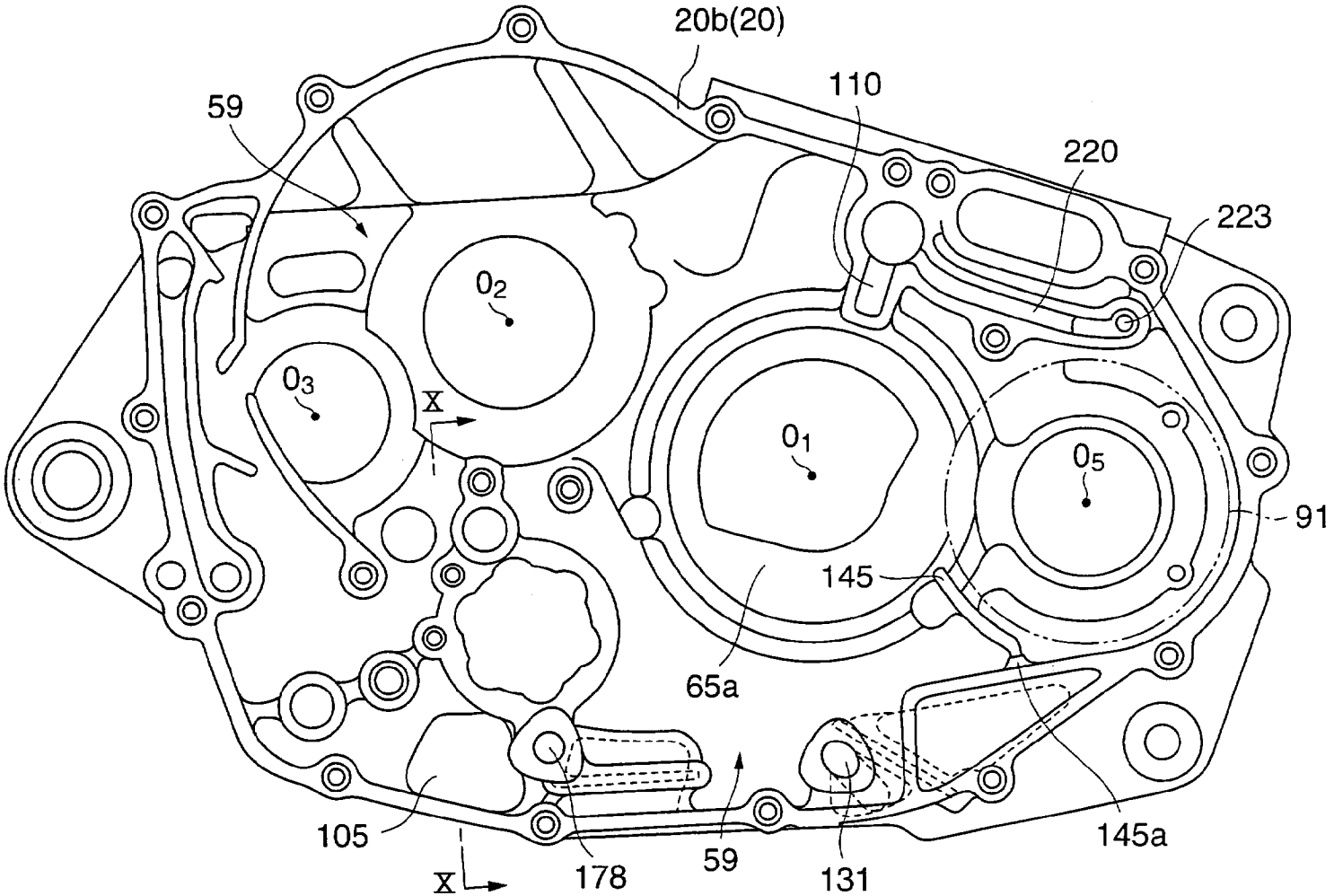
FIG. 6 is a side elevation of the right half-crankcase as viewed from the right side of the dry-sump lubrication type four-stroke cycle engine.
Figure 9:
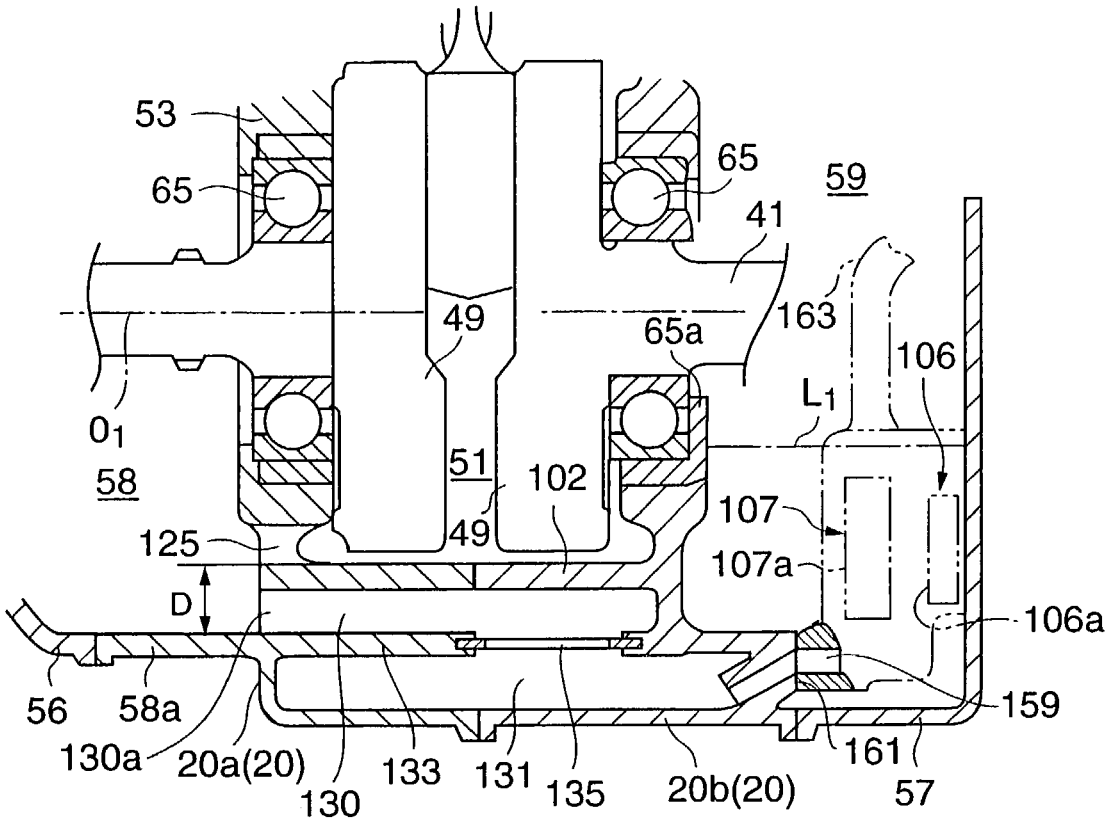
FIG. 9 is a schematic sectional view taken on the line IX—IX in FIG. 3.

Referring to FIG. 9 showing a sectional view taken on the line IX—IX in FIG. 3, an oil feed pump 106 and a scavenging pump 107 are disposed coaxially in the clutch chamber 59 so that rotors 106*a* and 107*a* respectively included in the pumps 106 and 107 are below the oil level $L_1$. An insert 65*a* supporting the right bearing 65 supporting the crankshaft 41 seals the lower half of the bearing 65 to prevent oil from flowing from the clutch chamber 59 into the crank chamber 51. As shown in FIG. 6, the insert 65*a* has an inner edge having a semicircular upper half, and a lower half having the shape of a dam higher than the semicircular upper half so that the lowermost end of the inner edge is located above the oil level $L_1$ in the clutch chamber 59.

The left end wall 53 of the crankcase 20 defining the left end of the crank chamber 51 is provided with three drain passages 125 opening into the bottom of the crank chamber 51 and the generator chamber 58. The openings opening into the generator chamber 58 of the drain passages 125 are at a height D from a bottom wall 58*a* defining the bottom of the generator chamber 58. Thus, oil is able to drain away from the crank chamber 51 through the drain passages 125 into the generator chamber 58 and is unable to flow from the generator chamber 58 into the crank chamber 51.

A first oil passage 130 and a second oil passage 131 are formed in the crankcase 20 in parallel to the axis $O_1$ of the crankshaft 41 under the bottom wall 102 defining the bottom of the crank chamber 51. The first oil passage 130 has a left end opening into the generator chamber 58 and a closed right end. The second oil passage 131 has a closed left end and a right end opening into the clutch chamber 59 at a level below the oil level $L_1$. The oil passages 130 and 131 are separated by a partition wall 133. A flat third filter 135 is fitted in an opening formed in a right part of the partition wall 133, so that the oil passages 130 and 131 communicate with each other by means of the opening provided with the third filter 135. Thus, the generator chamber 58 on the left side and the clutch chamber 59 on the right side communicate with each other by means of the flat third filter 135 and the oil passages 130 and 131. The left open end 130*a* of the first oil passage 130 is positioned below the drain passages 125 opening into the crank chamber 51 by a distance corresponding to the height D. and is at the level of the inner surface of the bottom wall 58*a* defining the bottom of the generator chamber 58. Thus, oil flowed from the crank chamber 51 into the generator chamber 58 is drained quickly through the first oil passage 130.

Figure 5:
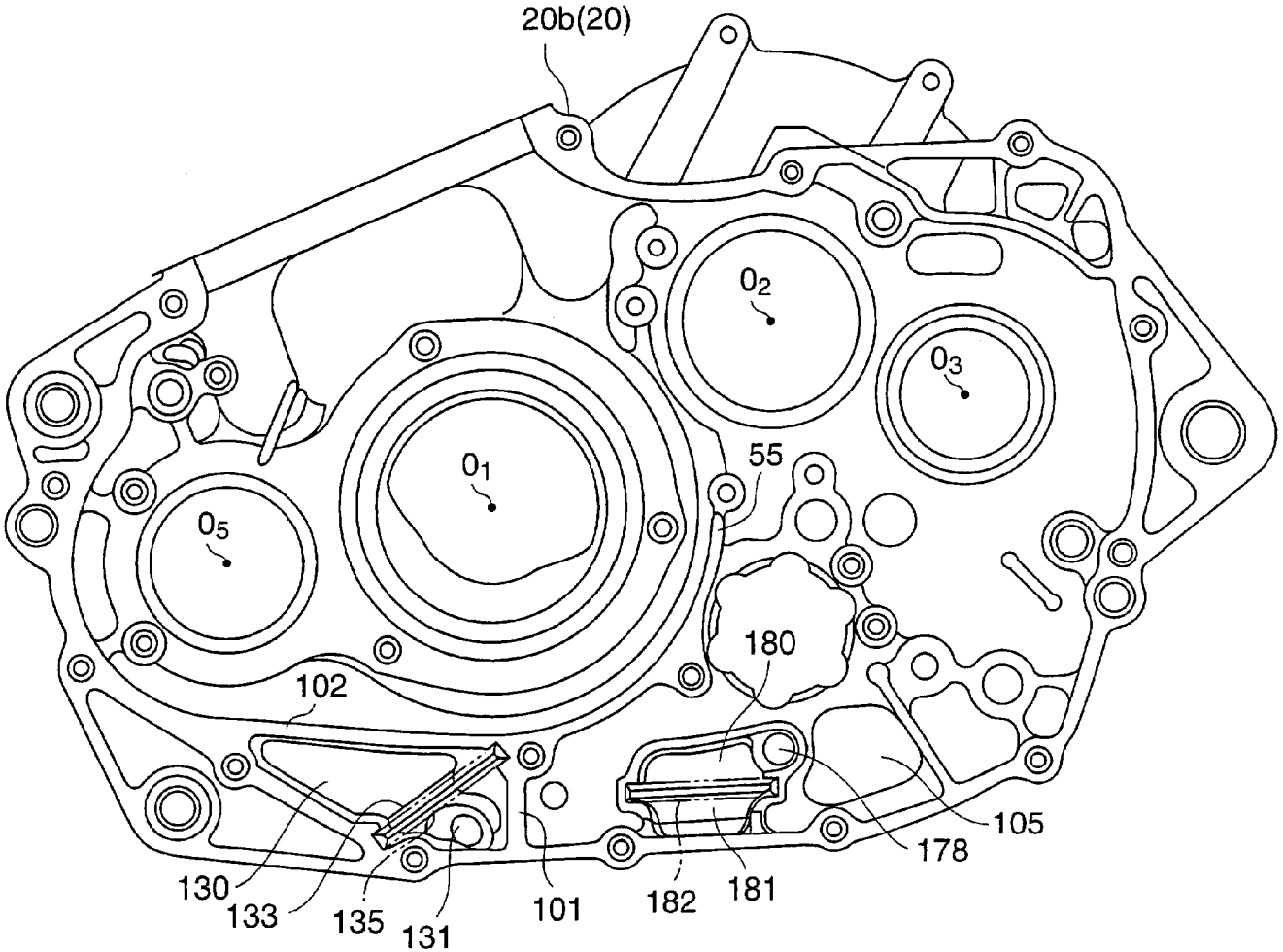
FIG. 5 is a side elevation of a right half-crankcase as viewed from the left side of the dry-sump lubrication type four-stroke cycle engine.

As shown in FIG. 3, the first oil passage 130 has a cross section substantially resembling an inverted isosceles triangle, and the second oil passage 131 extends in a rear and lower portion of the first oil passage 130 and has a cross section substantially resembling a right triangle. The partition wall 133 separating the oil passages 130 and 131 rises obliquely rearward. As shown in FIG. 5, the flat third filter 135 is inclined, like the partition wall 133, so as to rise obliquely rearward so that the third filter 135 has a large filtering area.

Figure 4:
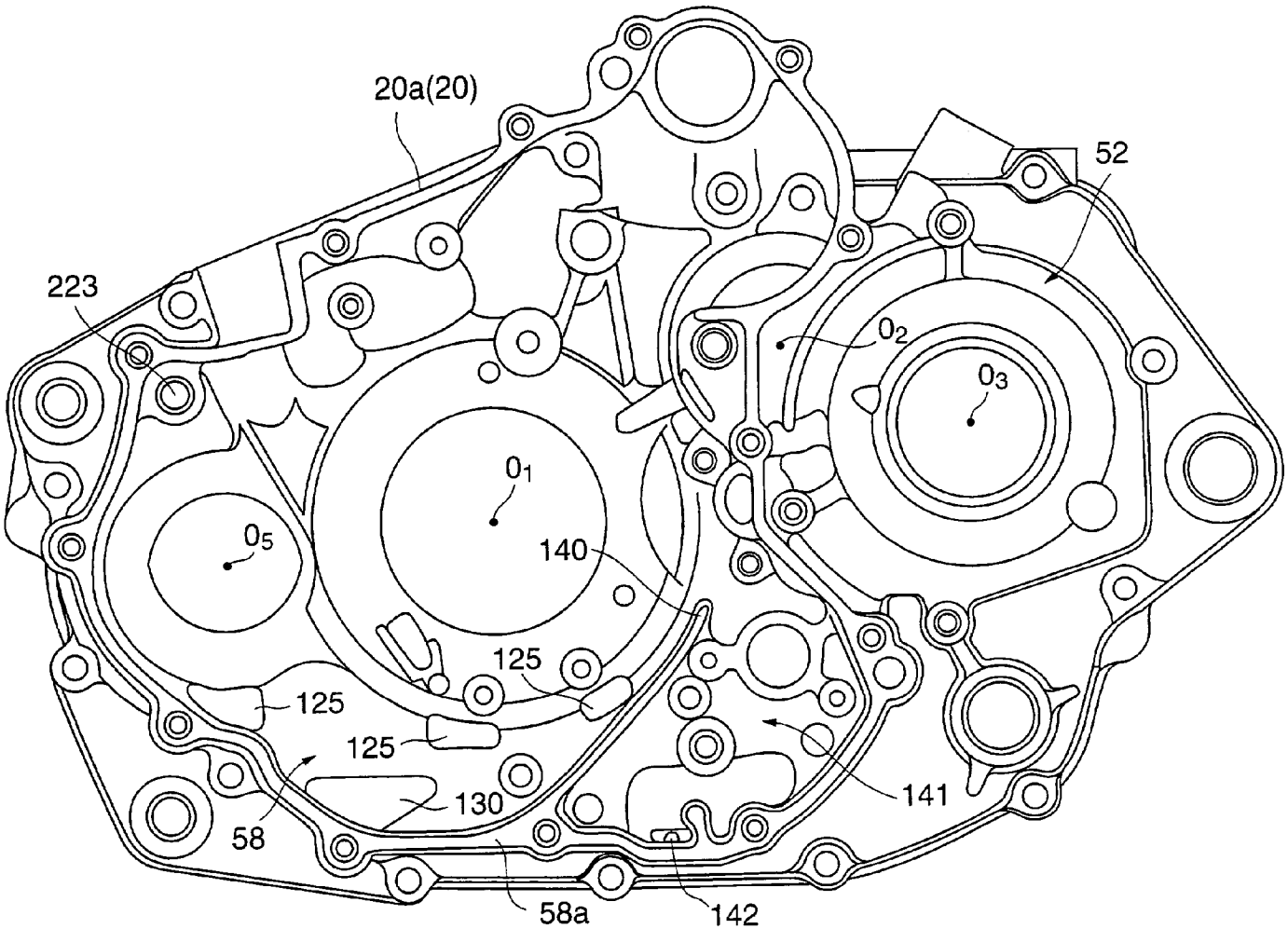
FIG. 4 is a side elevation of the left half-crankcase as viewed from the left side of the dry-sump lubrication type four-stroke cycle engine.

Referring to FIG. 4 showing the outer surface of the left half-crankcase 20*a*, the drain passages 125 opening into the generator chamber 58 are formed at three positions. In this embodiment, the drain passages 125 are formed at a position substantially directly under the axis $O_1$ of the crankshaft 41, a position slightly behind the position substantially directly under the axis $O_1$, and at a position substantially directly under the axis $O_5$ of the balancer shaft 50, respectively. A sub-oil reservoir chamber 141 (third oil reservoir chamber) is formed behind and under the generator chamber 58 and is separated from the generator chamber 58 by a partition wall 140. The chamber 141 communicates with the oil reservoir chamber 64 by means of a connecting passage 142 opening in the bottom of the chamber 141 as shown in FIG. 3. Thus, the level of oil in the chamber 141 is equal to the oil level $L_1$ in the oil reservoir chamber 64.

Referring to FIG. 6 showing the outer surface of the right half-crankcase 20*b*, a dam 145 is formed integrally with the crankcase 20 in the clutch chamber 59 so as to cover a lower rear part of the balancer gear (scissors gear) 91 to hold a predetermined quantity of oil around a lower half part of the balancer gear 91. A small opening 145*a* is formed at the lower end of the dam 145.

[Oil Feed Pump and Scavenging Pump]

Figure 7:
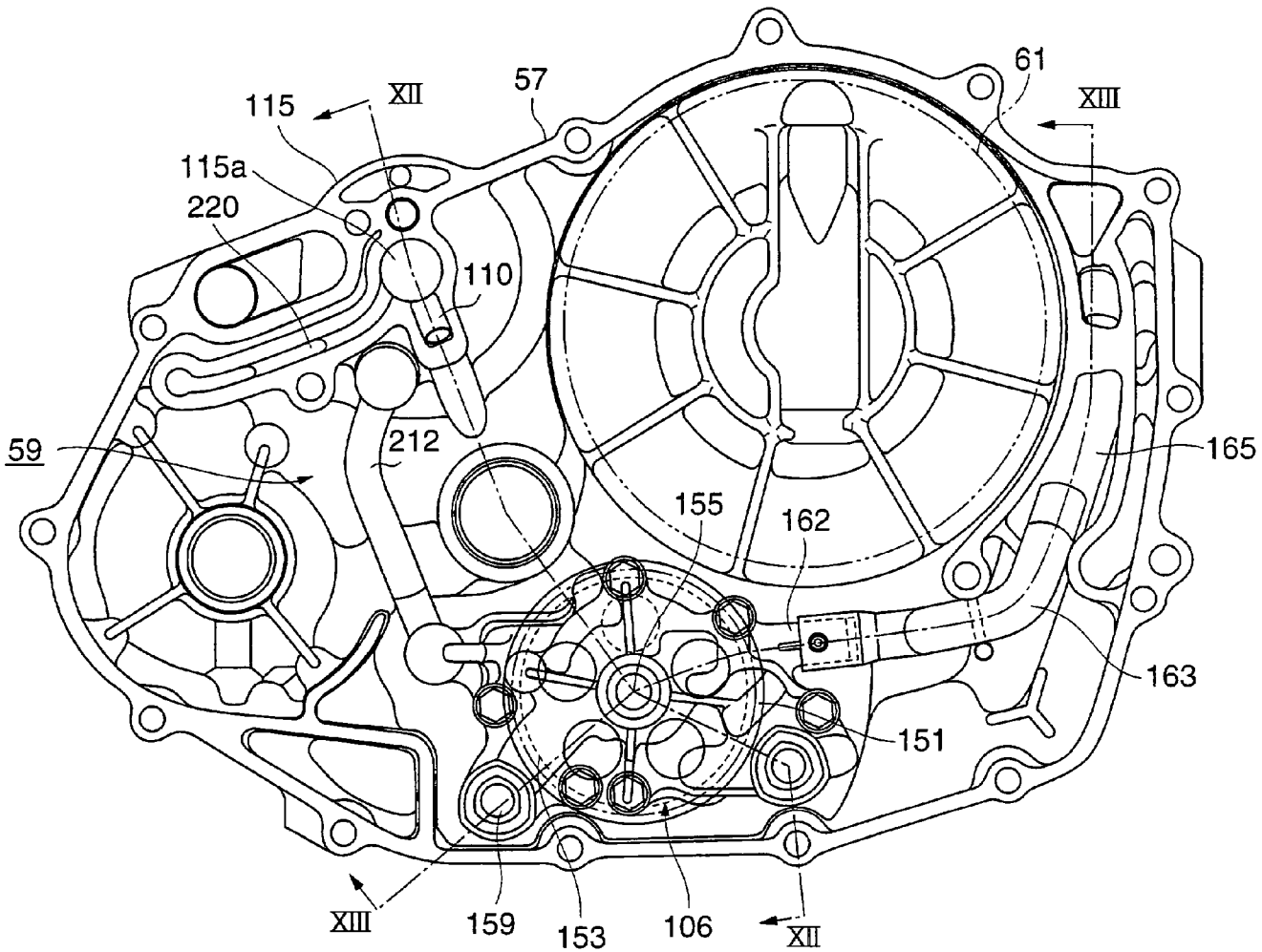
FIG. 7 is a side elevation of the inner surface of a clutch cover.
Figure 12:
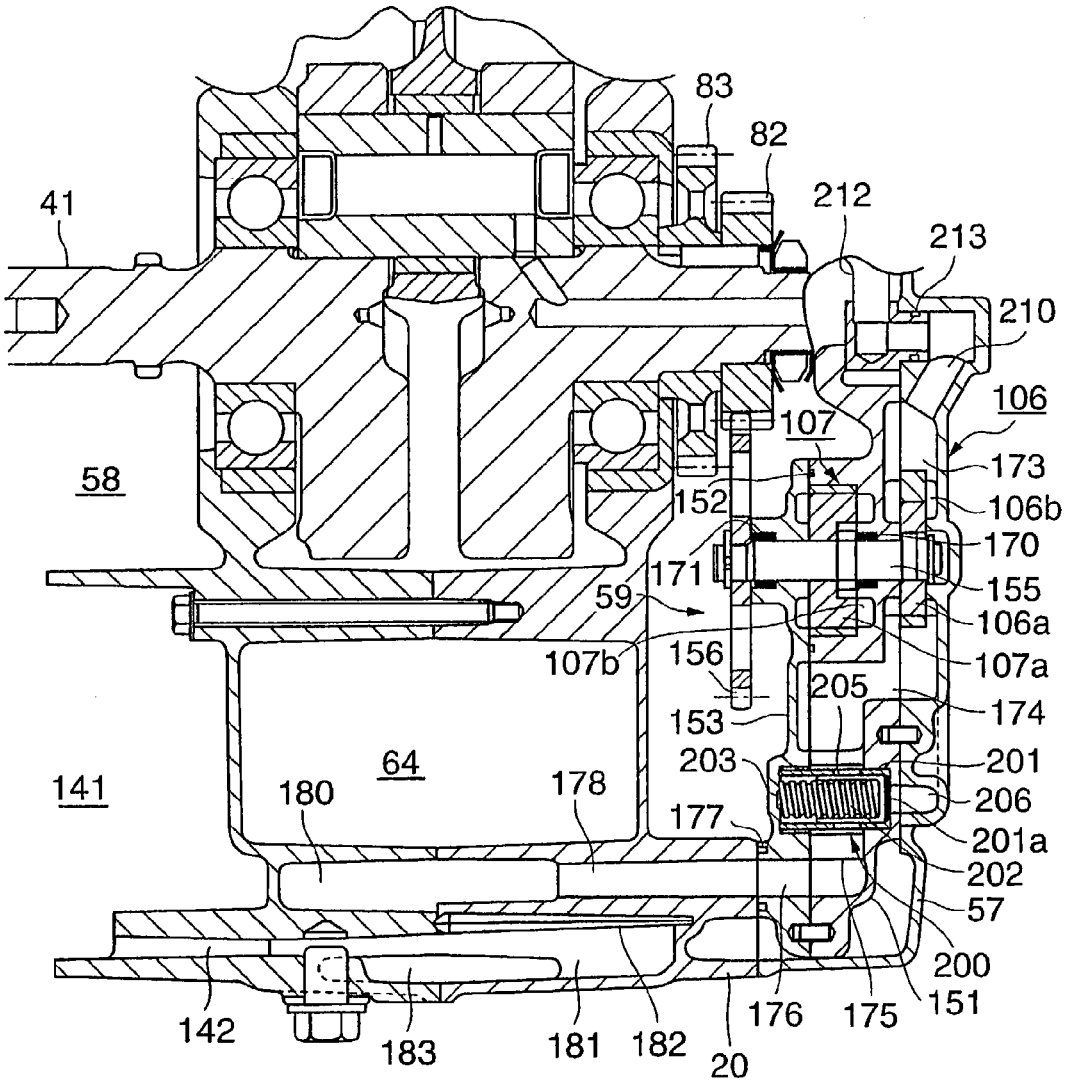
FIG. 12 is a sectional view taken on the line XII—XII in FIG. 7.

Referring to FIG. 12 showing a sectional view taken on the line XII-XII in FIG. 7, the oil feed pump 106 for pumping up oil from the oil reservoir chamber 64 and distributing oil by pressure to the parts needing lubrication of the engine, and the scavenging pump 107 for sucking oil from the generator chamber 58 and discharging the oil into the clutch chamber 59 are attached to the clutch cover 57 in the clutch chamber 59. The pumps 106 and 107 are trochoid pumps having each an outer rotor and an inner rotor.

The clutch cover 57, a pump housing 151 and a pump cover 153 form the casing of the pumps 106 and 107. The pump housing 151 is fastened to the inner surface of the clutch cover 57, and the pump cover 153 is fastened to the left end surface of the pump housing 151. An O ring 152 is held between the pump housing 151 and the pump cover 153. The rotor 106*a* of the oil feed pump 106 is placed in a rotor chamber 106*b* formed in the clutch cover 57. The rotor 107*a* of the scavenging pump 107 is placed in a rotor chamber 107*b* formed in the pump housing 151. The respective rotors 106*a* and 107*a* of the pumps 106 and 107 are fixedly mounted on the same rotor shaft 155. The common rotor shaft 155 is supported on the pump housing 151 and the pump cover 153, is extended through the pump cover 153 so as to project into the clutch chamber 59. A pump gear 156 is fixedly mounted on the projecting part and is engaged with the crankshaft gear 82 of the crankshaft 41.

[Scavenging Pump]

Figure 13:
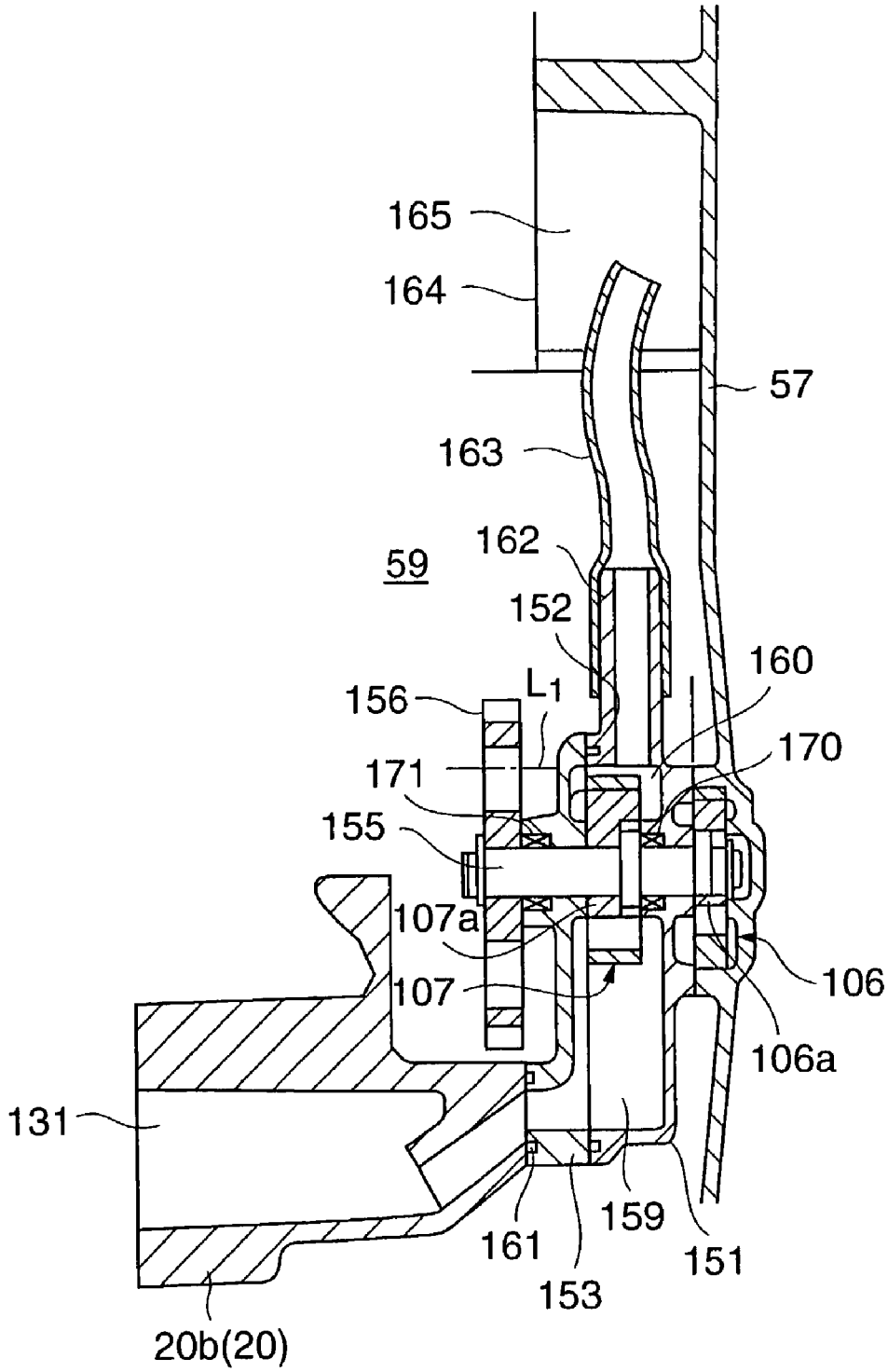
FIG. 13 is a sectional view taken on the line XIII—XIII in FIG. 7.

Referring to FIG. 13 showing a sectional view taken on the line XIII—XIII in FIG. 7, a suction part (suction passage) 159 of the scavenging pump 107 terminates in an opening formed in the left end of the pump cover 153. The left end of the pump cover 153 is joined to the right half-crankcase 20*b* so that the suction part 159 of the scavenging pump 107 is connected to the second oil passage 131. An O ring 161 is held between the left end of the pump cover 153 and the right end of the right half-crankcase 20*b* so as to surround the opening formed in the left end of the pump cover 153. A discharge pipe 162 is formed integrally with the pump housing 151 so as to be connected to a discharge part 160 of the scavenging pump 107. A rubber hose 163 is connected to the discharge pipe 162. As shown in FIG. 7 and FIG. 13, the rubber hose 163 extends rearward and obliquely upward in the clutch chamber 59, is inserted in an oil discharge chamber 165 surrounded by the end wall of the clutch cover 57 and a gasket 164, and opens toward the end wall of the clutch cover 57. Since the rubber hose 163 opens into the atmosphere at a level above the oil level $L_1$ and makes oil collide against the inner surface of the clutch cover 57, gases contained in oil are separated from oil, and oil is contained in the clutch chamber 59. The gasket 164 is held between the right end of the clutch case 57 and the right end surface of the right half-crankcase 20*b*.

To prevent the flow of oil from the clutch chamber 59 into the scavenging pump 107, oil seals 170 and 171 are provided, on the opposite sides of the rotor 107*a* of the scavenging pump 107, between the rotor shaft 155 and insertion holes of the rotor shaft 155 formed in the pump cover 153 and the pump housing 151, in addition to the O rings 152 and 161 sealing the joint of the pump housing 151 and the pump cover 153 and the joint of the pump cover 153 and the crankcase 20.

[Oil Feed Pump]

Referring to FIG. 12, the oil feed pump 106 has a suction part 174 opening into an oil chamber 175 in the pump housing 151 connected to a suction hole 176 formed in the pump cover 153 and opening toward the left. An O ring 177 is held between the pump cover 153 provided with the suction hole 176 and the crankcase 20 so as to surround the suction hole 176. The suction hole 176 is connected to an oil inlet passage 178 formed in a bottom part of the oil reservoir chamber 64. The oil inlet passage 178 communicates with an upper oil inlet chamber 180 formed in a bottom part of the oil reservoir chamber 64. The upper oil inlet chamber 180 is connected through a flat, primary filter 182 set in a substantially horizontal position to a lower oil inlet chamber 181 communicating with the oil reservoir chamber 64 by means of an oil passage 183.

A relief valve 200 is placed in a suction chamber 175 formed in the oil feed pump 106. The relief valve 200 opens after the discharge pressure of the oil feed pump 106 has increased beyond a set pressure to return part of oil from a discharge chamber 173 through an oil return passage 206 and the relief valve 200 into the suction chamber 175.

The relief valve 200 includes a valve case 201 having the shape of a cylinder with a bottom wall, a cylindrical plunger 202 axially slidably fitted in the valve case 201, and a valve spring 203 pushing the plunger 202 in a valve-closing direction. The valve case 201 is fixed to the pump housing 151 so as to extend laterally across the oil chamber 175. The valve case 201 is provided in its side wall with oil return holes 205 arranged at angular intervals and opening into the oil chamber 175. The right end surface (pressure-receiving surface) of the plunger 202 is exposed through an opening 201*a* formed in the right end wall (the bottom wall) of the valve case 201 to the oil return passage 206. Normally, the plunger 302 is biased to the right by the valve spring 203 so that the oil return holes 205 are closed. As the discharge pressure of the oil feed pump 106 increases beyond the set pressure, the plunger 202 is shifted to the left against the resilient force of the valve spring 203 and the oil return holes 205 are opened to return part of oil into the oil chamber 175 on the suction side. Although the relief valve 200 appears to be blocking the oil chamber 175 in FIG. 12, actually, the oil chamber 175 is wide and surrounds the relief valve, and the suction part 174 is connected always to the suction hole 176.

The discharge part 173 of the oil feed pump 106 is connected to an oil feed passage 210 formed in the clutch cover 57, the oil feed passage 210 has an opening that opens into the clutch chamber 59, and an oil feed pipe 212 is connected to the opening of the oil feed passage 210 by a connector 213.

[Oil Feed Circuit]

FIG. 7 shows the inner surface of the clutch cover 57 with a pump assembly, i.e., an assembly of the oil feed pump 106 and the scavenging pump 107, fastened thereto. The oil feed pipe 212 connected to the discharge side of the oil feed pump 106 extends upward in the clutch chamber 59 and is connected to the inlet side of the second filter 115.

An oil feed passage 220 extends forward from an outlet 115*a* of the second filter 115, and a crankshaft lubricating oil feed passage 110 extends downward from the outlet 115*a* of the second filter 115. As shown in FIG. 6, the oil feed passages 220 and 110 are formed in the joining surface of the clutch cover 57 to be joined to the right half-crankcase 20*b*. The oil feed passage 110 extending downward is connected to the oil passage 111 formed in the crankshaft 41 shown in FIG. 2. As shown in FIG. 6, the oil feed passage 220 extending toward the front is connected to an oil feed passage 223 parallel to the axis of the crankshaft 41. Thus, the oil feed passage 223 extends across the crankcase 20 to the left end of the crankcase 20.

Figure 11:
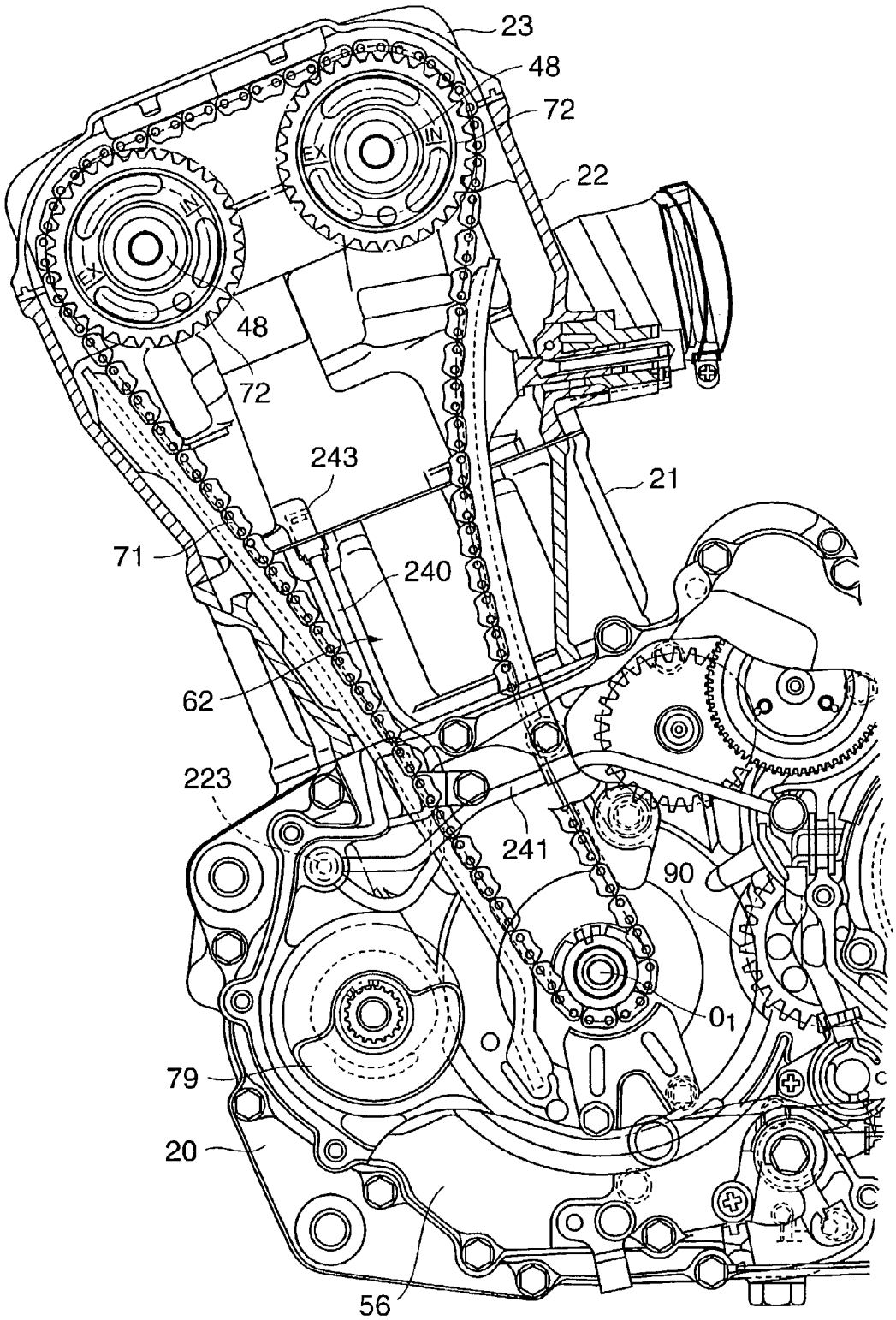
FIG. 11 is a sectional view taken on the line XI—XI in FIG. 2.

Referring to FIG. 4, the oil feed passage 223 extending across the crankcase 20 has an opening that opens into the generator chamber 58. Two oil feed pipes 240 and 241 are connected to the opening of the oil feed passage 223 as shown in FIG. 11.

Figure 18:
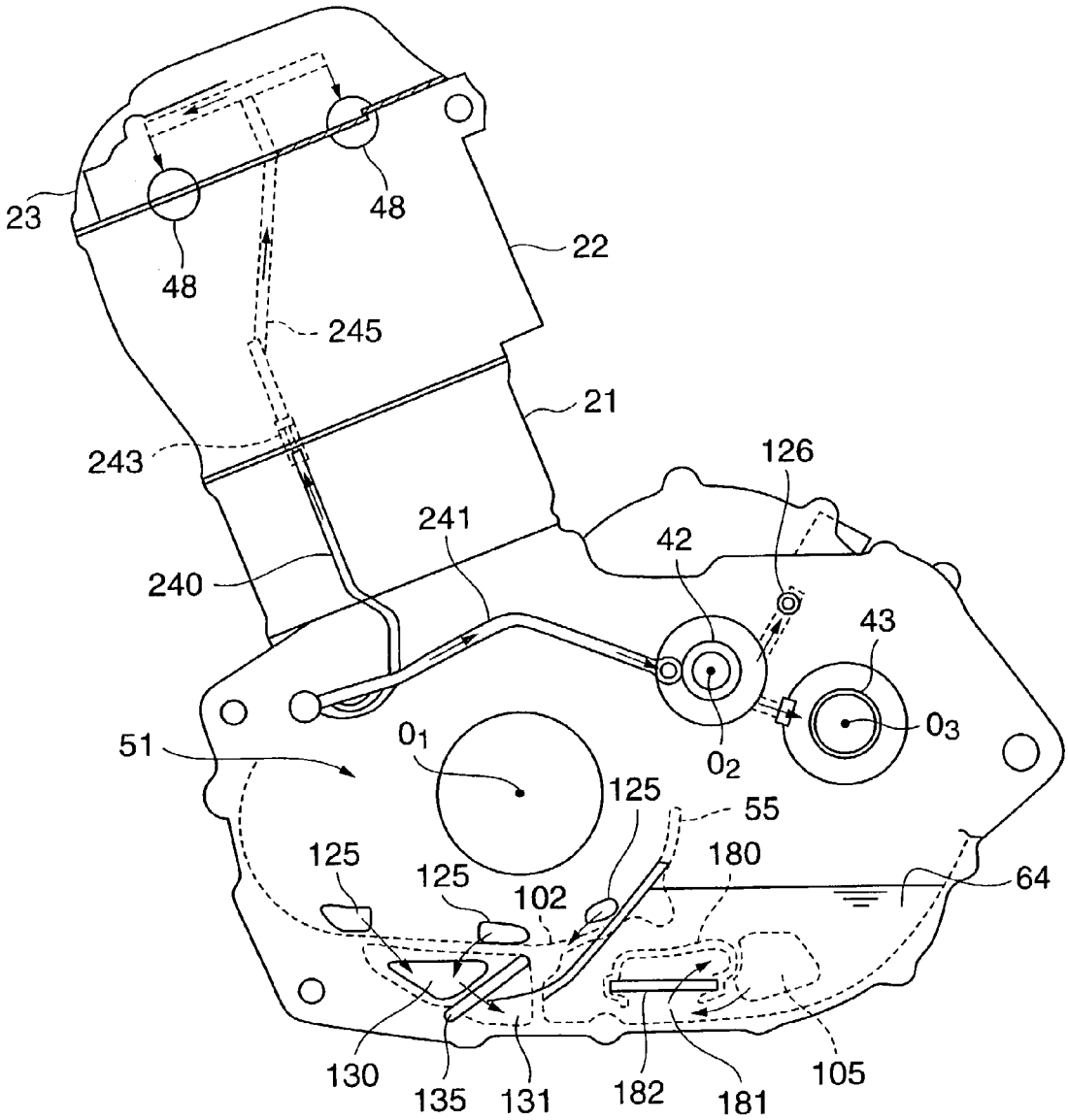
FIG. 18 is a schematic piping diagram of assistance in explaining the flow of oil to lubricated parts and the return flow of the oil.

The oil feed pipe 240 extends upward through the timing chain tunnel 62 and is connected to an oil inlet port 243 formed in the cylinder head 22. As shown in FIG. 18, an oil feed passage 245 extends from the oil inlet port 243 through the cylinder head 22 to a camshaft 48 in the cylinder head cover 23. The other oil feed pipe 241 extends rearward and is connected through the oil chamber 120 to the oil passage 118 of the transmission input shaft 42 and the oil passage 119 of the transmission output shaft 43 (ref. FIG. 2).

[Operations]

[Oil Feed from Oil Feed Pump to Parts Needing Lubrication]

Figure 16:
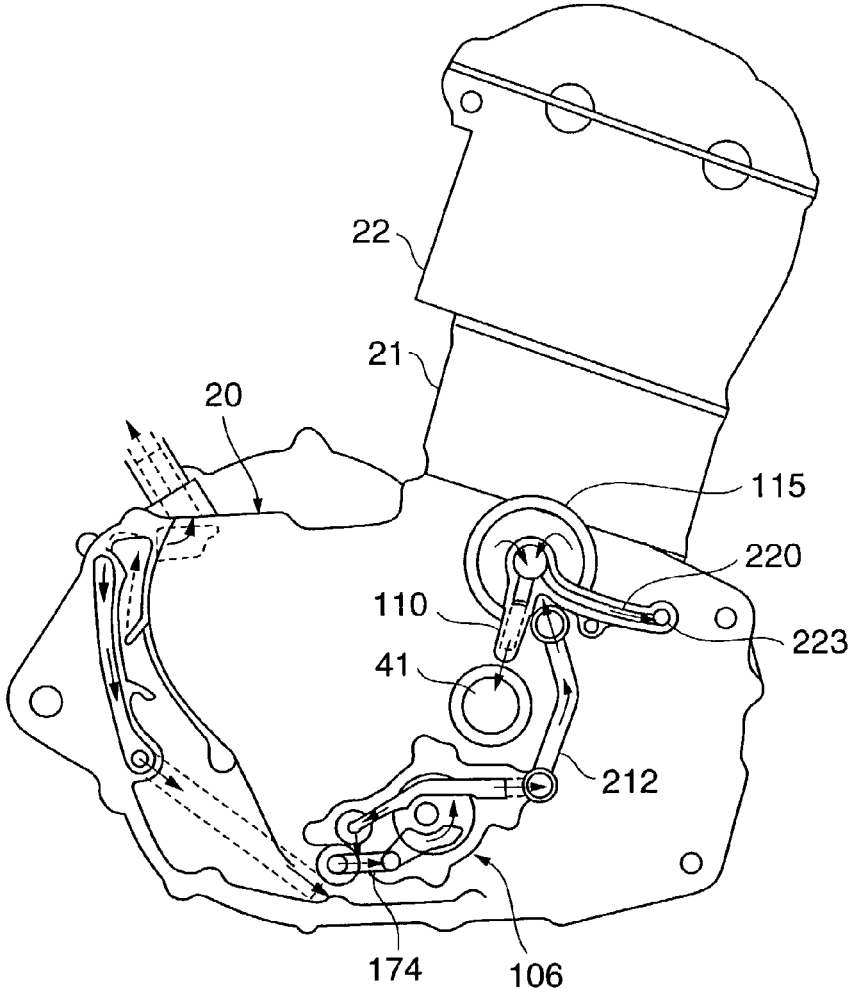
FIG. 16 is a schematic piping diagram of assistance in explaining the flow of oil caused by an oil feed pump in the dry-sump lubrication type four-stroke cycle engine.
Figure 17:
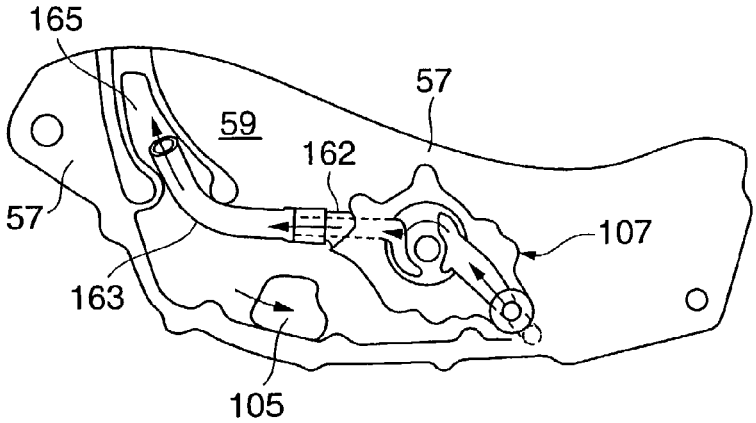
FIG. 17 is a schematic piping diagram of assistance in explaining the flow of oil caused by a scavenging pump in the dry-sump lubrication type four-stroke cycle engine.
Figure 19:
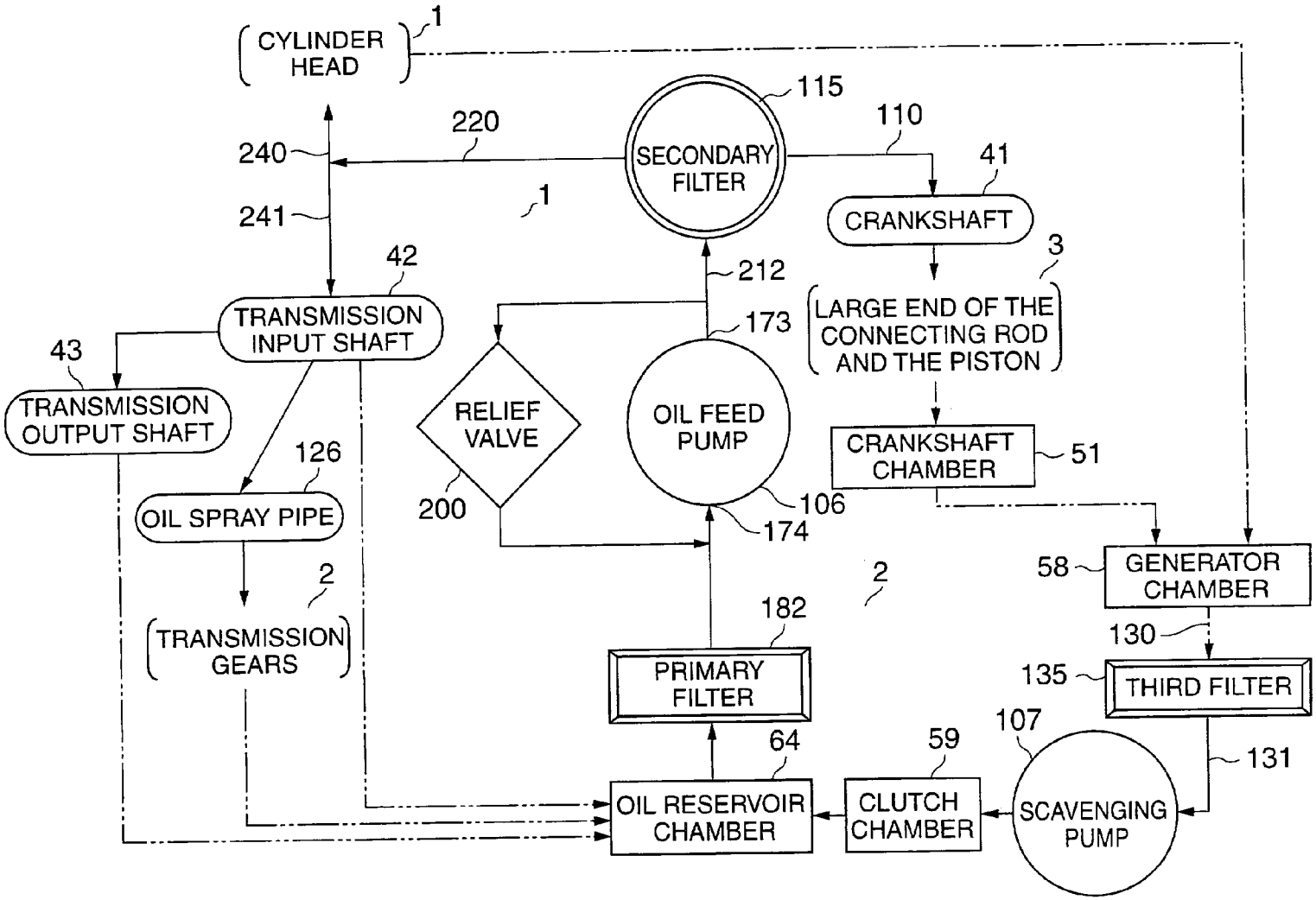
FIG. 19 is a block diagram of assistance in explaining the flow of oil in the dry-sump lubrication type four-stroke cycle engine.

The oil feed operation of the oil feed pump 106 will be briefly described with reference FIG. 19 showing an oil circulating system, FIG. 16 showing the flow of oil pumped by the oil feed pump 106, FIG. 17 showing the return flow of oil pumped by the scavenging pump 107, and FIG. 18 showing the flow of oil to parts needing lubrication and the return flow of oil.

Referring to FIG. 19, oil pumped up by the oil feed pump 106 from the oil reservoir chamber 64 through the flat primary filter 182 is distributed through the oil feed pipe 212 and the secondary filter 115 to the two oil feed passages 220 and 110 while the engine is in operation. The oil distributed to the oil feed passage 110 is fed to the crankshaft 41 to lubricate the components around the crankshaft 41, such as the crankpin, the piston and such. The oil distributed to the oil feed passage 220 flows into the two oil feed pipes 240 and 241. The oil is fed through the oil feed pipe 241 to the transmission input shaft 42 and the transmission output shaft 43 to lubricate sliding parts of the transmission gears, and to the oil spray pipe 126 to lubricate the teeth of the transmission gears. The oil feed pipe 240 carries the oil to members including the camshaft and held on the cylinder head 22.

[Other Parts Needing Lubrication]

Referring to FIG. 6 and FIG. 2, the balancer gear (scissors gear) 91 placed in the clutch chamber 59 splashes oil contained in the clutch chamber 59 to lubricate its teeth and those of the balancer drive gear 83 in mesh with the balancer gear 91. Referring to FIG. 12, the pump gear 156 splashes oil contained in the clutch chamber 59 to lubricates its teeth and those of the crankshaft gear 82 in mesh with the pump gear 156.

[Return Flow of Oil]

Referring to FIG. 2, the oil lubricated the camshaft 48 drips through the timing chain tunnel 62 into the generator chamber 58. The oil fed to the crankshaft 41 and the associated parts drips into the crank chamber 51. The oil lubricated the transmission M drips into the oil reservoir chamber 64 defined in the lower part of the transmission chamber 52.

Referring to FIG. 9, the oil collected in the bottom of the crank chamber 51 flows, through the oil drain passages 125 formed in the left end wall 53 of the crankcase 20, into the bottom of the generator chamber 58. The scavenging pump 107 sucks the oil collected in the bottom of the generator chamber 58 through the oil passage 130 formed in the bottom of the crank chamber 51, the third filter 135 and the oil passage 131 so as to suck the oil across the crankcase 20.

Thus, the oil collected in the bottom of the crank chamber 51 flows through the oil drain passages 125 into the generator chamber 58, and then scavenging pump 107 sucks the oil from the generator chamber 58 and returns the oil to the clutch chamber 59. Therefore, the suction of the scavenging pump 107 is not affected by the variation of pressure in the crank chamber 51, the revolving crank arms 49 do not splash oil, and hence the ability of the scavenging pump 107 can be fully utilized. Therefore, the scavenging pump 107 is able to pump oil at a necessary pumping rate even if the same does not have a large pumping capacity.

Referring to FIG. 13, the scavenging pump 107 sucks in oil from the oil passage 131, pressurizes the oil, pumps the oil upward through the rubber hose 163, and discharges the oil toward the end wall of the clutch cover 57 in the oil discharge chamber 165 at the level above the oil level $L_1$. Then, gases are separated from the oil, only the oil collects in a lower part of the clutch chamber 59. Then, the oil flows from the clutch chamber 59 through the connecting hole 105 into the oil reservoir chamber 64 in the crankcase 20 as shown in FIG. 10 and is held in the oil reservoir chamber 64. The oil also flows through the connecting passage 142 shown in FIG. 12 into the sub-oil chamber 141 (third oil reservoir chamber) behind and under the generator chamber 58.

Even when the engine is stopped for a long time, oil does not flow in the reverse direction from the oil reservoir chamber 64 and the clutch chamber 59 through the scavenging pump 107 into the generator chamber 58 and the crank chamber 51 because the gaps around the scavenging pump 107 are sealed by the oil seals 170 and 171 and O rings 152 and 161. Thus, the crank chamber 51 can be maintained in a dry state, and oil levels in the clutch chamber 59 and the oil reservoir chamber 64 can be held constant. Therefore, the quantity of oil contained in the oil reservoir chamber 64 can be accurately measured even after the engine has been kept stopped for a long time. Since the scavenging pump 107 keeps the generator chamber 58 in a dry state in principle while the engine is in operation and the oil passages 130 and 131 are at levels below that of the drain passages 125, oil will not flow in the reverse direction into the crank chamber 51.

[Modifications]

Oil may be drained from the crank chamber into the clutch chamber, and the oil contained in the clutch chamber may be pumped by the scavenging pump into the oil reservoir chamber.

Although the invention has been described in its preferred embodiments with a certain degree of particularity, obviously various changes and variations are possible therein. It is therefore to be understood that the present invention may be practiced otherwise than as specifically described herein without departing from the scope and spirit thereof.

What is claimed is:

1. A dry-sump lubrication type four-stroke cycle engine comprising:

a crankcase in which a crank chamber is formed in its front part and a transmission chamber is formed in its rear part, the crankcase having a pair of end walls positioned at one end and other end along a crank axis direction, respectively;

a first cover and a second cover disposed on the end walls of the crankcase, respectively; and a first chamber and a second chamber formed in the first cover and the second cover, respectively, wherein a partition wall of a given height is provided between the crank chamber and the transmission chamber so as to form an oil reservoir chamber in a lower part of the transmission chamber separated from the crank chamber by the partition wall, wherein one of the end walls is provided with a drain passage through which oil drains from the crank chamber into the first chamber, wherein the second chamber has a second oil reservoir chamber which communicates with the oil reservoir chamber so that a level of oil contained in the second oil reservoir chamber is equal to a level of oil in the oil reservoir chamber, and wherein the engine further comprising a scavenging pump pumping up oil from the first chamber and discharges oil into the oil reservoir chamber or the second oil reservoir chamber.

2. The dry-sump lubrication type four-stroke cycle engine according to claim 1, wherein the first and the second chamber are connected by an oil passage, wherein the scavenging pump is disposed in the second chamber, and a suction port of the scavenging pump is connected to one end of the oil passage to suck oil directly from the first chamber.

3. The dry-sump lubrication type four-stroke cycle engine according to claim 2, wherein the oil passage is formed below the drain passage connecting the crank chamber to the first chamber so as to extend under the crank chamber across the crankcase.

4. The dry-sump lubrication type four-stroke cycle engine according to claim 3, wherein the oil passage is formed integrally with the crankcase.

5. The dry-sump lubrication type four-stroke cycle engine according to claim 2, wherein the scavenging pump is placed in the second chamber so as to position a rotor thereof below a predetermined oil level in the second oil reservoir chamber.

6. The dry-sump lubrication type four-stroke cycle engine according to claim 5, wherein the scavenging pump placed in the second chamber is sealed so that oil is unable to flow in a reverse direction from the second chamber.

7. The dry-sump lubrication type four-stroke cycle engine according to claim 2, wherein the scavenging pump has a discharge opening at a level above a level of oil in the second chamber to discharge oil into air.

8. The dry-sump lubrication type four-stroke cycle engine according to claim 2, wherein a flat filter is placed in the oil passage.

9. The dry-sump lubrication type four-stroke cycle engine according to claim 1, wherein a generator of the engine is placed in the first chamber communicating with the crank chamber, and a clutch of the engine is placed in the second chamber communicating with the oil reservoir chamber.

10. The dry-sump lubrication type four-stroke cycle engine according to claim 9, wherein the clutch is placed in the second chamber so that the clutch is not immersed in oil.

11. The dry-sump lubrication type four-stroke cycle engine according to claim 1, wherein transmission gears of a transmission installed in the transmission chamber are disposed so that the transmission gears are not immersed in oil contained in the oil reservoir chamber, and an oil spraying unit is placed in the transmission chamber to spray oil on the transmission gears.

* * * * *